US009581365B2

(12) United States Patent
Furui et al.

(10) Patent No.: US 9,581,365 B2
(45) Date of Patent: Feb. 28, 2017

(54) REFRIGERATING APPARATUS

(75) Inventors: Shuji Furui, Osaka (JP); Kazuhiro Furusho, Osaka (JP); Hirokazu Fujino, Osaka (JP); Hiroshi Yoh, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 523 days.

(21) Appl. No.: 14/241,158

(22) PCT Filed: Sep. 3, 2012

(86) PCT No.: PCT/JP2012/005564

§ 371 (c)(1),
(2), (4) Date: Feb. 26, 2014

(87) PCT Pub. No.: WO2013/038615

PCT Pub. Date: Mar. 21, 2013

(65) Prior Publication Data

US 2015/0276280 A1 Oct. 1, 2015

(30) Foreign Application Priority Data

Sep. 12, 2011 (JP) ..... 2011-197946

(51) Int. Cl.
*F25B 41/04* (2006.01)
*F25B 30/02* (2006.01)
(Continued)

(52) U.S. Cl.
CPC ..... *F25B 30/02* (2013.01); *F25B 13/00* (2013.01); *F25B 39/00* (2013.01); *F25B 40/02* (2013.01);
(Continued)

(58) Field of Classification Search
CPC ..... F25B 30/02; F25B 13/00; F25B 39/00; F25B 40/02; F25B 2313/025; F25B 2313/02741; F25B 2600/2507; F28D 1/05391
See application file for complete search history.

(56) References Cited

U.S. PATENT DOCUMENTS 5,107,684 A * 4/1992 Nakayama ..... F24F 3/065 62/160
5,878,810 A * 3/1999 Saito ..... F25B 1/02 165/240
(Continued)

FOREIGN PATENT DOCUMENTS

JP 62-038562 U 3/1987
JP 63-306364 A 12/1988
(Continued)

OTHER PUBLICATIONS

International Search Report issued in PCT/JP2012/005564, mailed on Nov. 27, 2012.
(Continued)

*Primary Examiner* — Ljiljana Ciric
(74) *Attorney, Agent, or Firm* — Birch, Stewart, Kolasch & Birch, LLP

(57) ABSTRACT

In an air conditioner which is a refrigerating apparatus, a superheat degree controller is provided, which is configured to control, in an evaporation mode of an outdoor heat exchanger, the opening degree of an expansion valve such that the superheat degree of refrigerant whose flows are joined together after passing through a main heat exchange part and an auxiliary heat exchange part reaches a predetermined superheat degree. Moreover, in the air conditioner, a flow volume adjustment valve configured to adjust, in the evaporation mode of the outdoor heat exchanger, a flow ratio of refrigerant in the heat exchange parts and a flow ratio controller configured to control the flow volume adjustment
(Continued)

valve such that refrigerant temperatures after passage through the heat exchange parts are substantially equal to each other are provided.

4 Claims, 16 Drawing Sheets

(51) Int. Cl.
*F25B 13/00* (2006.01)
*F25B 39/00* (2006.01)
*F25B 40/02* (2006.01)
*F28D 1/053* (2006.01)

(52) U.S. Cl.
CPC ..... *F28D 1/05391* (2013.01); *F25B 2313/025* (2013.01); *F25B 2313/02741* (2013.01); *F25B 2600/2507* (2013.01); *F25B 2600/2513* (2013.01); *F28F 2215/02* (2013.01)

(56) References Cited

U.S. PATENT DOCUMENTS 9,163,865 B2 * 10/2015 Wakamoto ..... F25B 41/00
2006/0042282 A1 * 3/2006 Ludwig ..... F25B 41/04 62/222
2006/0230770 A1 * 10/2006 Kitsch ..... F25B 13/00 62/151
2008/0296005 A1 12/2008 Taras et al.
2009/0100849 A1 * 4/2009 Nishimura ..... F25B 45/00 62/149
2009/0151374 A1 * 6/2009 Kasahara ..... F25B 13/00 62/149
2009/0158764 A1 * 6/2009 Kim ..... F25B 13/00 62/225
2009/0241573 A1 * 10/2009 Ikegami ..... B60H 1/00335 62/238.7
2009/0260380 A1 * 10/2009 Okamoto ..... F25B 1/10 62/204
2010/0126211 A1 * 5/2010 Okamoto ..... F25B 31/004 62/470
2010/0154447 A1 * 6/2010 Yoshimi ..... F25B 49/005 62/149
2010/0162742 A1 7/2010 Shimoda et al.
2010/0175400 A1 * 7/2010 Kasahara ..... F25B 1/10 62/225
2010/0198415 A1 * 8/2010 Kawano ..... F25B 13/00 700/282
2011/0011124 A1 * 1/2011 Matsuura ..... C09K 5/045 62/468
2011/0011125 A1 * 1/2011 Kasahara ..... F25B 13/00 62/498
2011/0030407 A1 * 2/2011 Yoshimi ..... F25B 9/008 62/324.5
2011/0030409 A1 * 2/2011 Fujimoto ..... F25B 1/10 62/324.6
2011/0036119 A1 * 2/2011 Fujimoto ..... F25B 1/10 62/510
2011/0048055 A1 * 3/2011 Fujimoto ..... F25B 1/10 62/324.6
2011/0197607 A1 * 8/2011 Tanaka ..... F24F 11/008 62/180
2011/0225998 A1 * 9/2011 Yamashita ..... F24F 3/065 62/126
2011/0302948 A1 * 12/2011 Honda ..... F24D 3/08 62/324.6
2012/0168139 A1 * 7/2012 Takata ..... F24F 3/065 165/200
2012/0260678 A1 * 10/2012 Yoshida ..... F25B 41/062 62/56
2012/0297806 A1 * 11/2012 Honda ..... F25B 30/02 62/222
2013/0067944 A1 * 3/2013 Kibo ..... F24F 11/008 62/157
2013/0118197 A1 * 5/2013 Kibo ..... F25B 1/00 62/222
2013/0233008 A1 * 9/2013 Yamashita ..... F25B 1/10 62/196.1
2014/0083123 A1 * 3/2014 Yamashita ..... F25B 13/00 62/222

FOREIGN PATENT DOCUMENTS

JP 5-118682 A 5/1993
JP 6-337174 A 12/1994
JP 2001-91099 A 4/2001
JP 2006-336947 A 12/2006
JP 2007-237113 A 9/2007
JP 2008-064447 A 3/2008
JP 2008-528946 A 7/2008
JP 2010-025447 A 2/2010
JP 2012-077921 A 4/2012

OTHER PUBLICATIONS

International Preliminary Report on Patentability and Written Opinion of the International Searching Authority (Forms PCT/IB/336, PCT/IB/373 and PCT/ISA/237) for International Application No. PCT/JP2012/005564 dated Mar. 20, 2014.

* cited by examiner

REFRIGERATING APPARATUS

TECHNICAL FIELD

The present disclosure relates to a refrigerating apparatus including a heat-source-side heat exchanger and a utilization-side heat exchanger. In particular, the present disclosure relates to improvement of an evaporative capacity of the heat-source-side heat exchanger.

BACKGROUND ART

Conventionally, a refrigerating apparatus has been known, which is configured such that an air-cooling/air-heating operation is performed using refrigerant circulating in a refrigerant circuit in which a heat-source-side heat exchanger (i.e., an outdoor heat exchanger) and a utilization-side heat exchanger (i.e., an indoor heat exchanger) are connected together. For example, Patent Document 1 discloses the refrigerating apparatus of this type. In the refrigerating apparatus, the air-cooling operation is performed using refrigerant circulating such that the heat-source-side heat exchanger functions as a condenser and that the utilization-side heat exchanger functions as an evaporator. On the other hand, the air-heating operation is performed using refrigerant circulating in a direction opposite to that in the air-cooling operation such that the heat-source-side heat exchanger functions as the evaporator and that the utilization-side heat exchanger functions as the condenser.

Patent Document 2 discloses a heat exchanger functioning as a condenser. The heat exchanger includes two headers and a plurality of heat transfer pipes arranged in the vertical direction between the headers. A main heat exchange part for condensation is formed in an upper part of the heat exchanger, and an auxiliary heat exchange part for subcooling is formed in a lower part of the heat exchanger. While passing through the main heat exchange part, refrigerant flowing into the heat exchanger is condensed into a substantially liquid state. After the refrigerant flows into the auxiliary heat exchange part, the refrigerant is further cooled.

CITATION LIST

Patent Document

PATENT DOCUMENT 1: Japanese Unexamined Patent Publication No. 2008-064447

PATENT DOCUMENT 2: Japanese Unexamined Patent Publication No. 2010-025447

SUMMARY OF THE INVENTION

Technical Problem

In the refrigerating apparatus of Patent Document 1, the heat exchanger (i.e., the heat exchanger including the main heat exchange part and the auxiliary heat exchange part) of Patent Document 2 may be employed as the heat-source-side heat exchanger. In such a case, since the direction in which refrigerant circulates is opposite between the air-cooling operation and the air-heating operation, the direction in which refrigerant circulates in the heat-source-side heat exchanger is also opposite between the air-cooling operation and the air-heating operation. That is, since refrigerant flows, in the heat-source-side heat exchanger, through the main heat exchange part and the auxiliary heat exchange part in this order in the air-cooling operation (i.e., a condensation mode), refrigerant flows through the auxiliary heat exchange part and the main heat exchange part in this order in the air-heating operation (i.e., an evaporation mode).

However, in the evaporation mode of the heat-source-side heat exchanger, if refrigerant is evaporated while passing through the auxiliary heat exchange part and the main heat exchange part in this order, the proportion of gas refrigerant in refrigerant of each heat transfer pipe of the heat exchange parts increases, and the flow velocity of refrigerant increases accordingly. As a result, a pressure loss of refrigerant, particularly a pressure loss of refrigerant while the refrigerant is passing through the auxiliary heat exchange part, increases.

A greater pressure loss of refrigerant while the refrigerant is passing through the auxiliary heat exchange part results in a greater refrigerant pressure difference between an inlet side of the auxiliary heat exchange part and an inlet side of the main heat exchange part. Accordingly, a refrigerant temperature difference between the inlet side of the auxiliary heat exchange part and the inlet side of the main heat exchange part increases. For such a reason, there is a disadvantage that, in the auxiliary heat exchange part, a sufficient heat absorption amount of refrigerant cannot be ensured due to a decrease in temperature difference between refrigerant and outdoor air.

In order to overcome such a disadvantage, the main heat exchange part and the auxiliary heat exchange part may be connected together in parallel in the evaporation mode of the heat-source-side heat exchanger. When the main heat exchange part and the auxiliary heat exchange part are connected together in parallel, refrigerant flows so as to branch into the heat exchange parts. Thus, the flow volume of refrigerant of each heat exchange part decreases as compared to the case where refrigerant passes through the auxiliary heat exchange part and the main heat exchange part in this order. As a result, a pressure loss of refrigerant while the refrigerant is passing through each heat exchange part decreases. In each heat exchange part, particularly in the auxiliary heat exchange part, the pressure of refrigerant on the inlet side decreases. Accordingly, the temperature of refrigerant decreases, and the temperature difference between refrigerant and outdoor air increases. Thus, a sufficient heat absorption amount of refrigerant can be ensured.

However, if the main heat exchange part and the auxiliary heat exchange part are connected together in parallel in the evaporation mode of the heat-source-side heat exchanger, there is the following disadvantage.

Refrigerant flowing into the heat-source-side heat exchanger is in a gas-liquid two-phase state. Thus, the liquid refrigerant having a higher specific gravity is more likely to flow into the auxiliary heat exchange part provided on the lower side, whereas the gas refrigerant having a lower specific gravity is more likely to flow into the main heat exchange part provided on the upper side.

In the case where more liquid refrigerant flows into the auxiliary heat exchange part due to an uneven flow of refrigerant, a pressure loss is greater in the auxiliary heat exchange part as compared to the case where no uneven flow of refrigerant occurs. Thus, in the auxiliary heat exchange part, the pressure of refrigerant on an outlet side decreases, and the temperature of refrigerant significantly decreases accordingly. As a result, frost is formed on the auxiliary heat exchange part due to over-cooling of surrounding air, and a heat exchange efficiency is lowered. Meanwhile, little liquid refrigerant flows in the main heat exchange part, resulting in the disadvantage that a sufficient evaporation amount cannot be ensured.

The present disclosure has been made in view of the foregoing, and aims to, in a heat-source-side heat exchanger in which a main heat exchange part and an auxiliary heat exchange part are connected together in parallel in an evaporation mode, reduce frost formation on the auxiliary heat exchange part and increase the evaporation amount of refrigerant in the main heat exchange part to improve an evaporative capacity (i.e., a cooling capacity).

Solution to the Problem

A first aspect of the invention is intended for a refrigerating apparatus including a refrigerant circuit in which a compressor (31), a heat-source-side heat exchanger (40), an expansion valve (33), and a utilization-side heat exchanger (32) are connected together and which is configured to perform a refrigeration cycle, in which the heat-source-side heat exchanger (40) includes an upper main heat exchange part (50) and a lower auxiliary heat exchange part (55) arranged in a vertical direction, the main heat exchange part (50) and the auxiliary heat exchange part (55) each include a standing first header (51, 56) and a standing second header (52, 57), a plurality of flat heat transfer pipes (53, 58) which are arranged in the vertical direction such that side surfaces thereof face each other and which are connected, at one end thereof, to the first header (51, 56) and connected, at the other end thereof, to the second header (52, 57), and a fin (54, 59) joined between adjacent ones of the heat transfer pipes, and a switching mechanism (60) configured to switch the heat-source-side heat exchanger (40) between an evaporation mode in which refrigerant is evaporated in the heat-source-side heat exchanger (40) while flowing so as to branch into the main heat exchange part (50) and the auxiliary heat exchange part (55) and a condensation mode in which the refrigerant is condensed while passing through the main heat exchange part (50) and the auxiliary heat exchange part (55) in this order is provided. The refrigerating apparatus includes a superheat degree controller (71) configured to control, in the evaporation mode of the heat-source-side heat exchanger (40), an opening degree of the expansion valve (33) such that a superheat degree of the refrigerant whose flows are joined together after passing through the main heat exchange part (50) and the auxiliary heat exchange part (55) reaches a predetermined superheat degree; a flow ratio adjustment mechanism (66, 67) configured to adjust, in the evaporation mode of the heat-source-side heat exchanger (40), a flow ratio between the refrigerant flowing through the main heat exchange part (50) and the refrigerant flowing through the auxiliary heat exchange part (55); and a flow ratio controller (72) configured to control the flow ratio adjustment mechanism (66) such that a temperature of the refrigerant having passed through the main heat exchange part (50) and a temperature of the refrigerant having passed through the auxiliary heat exchange part (55) are substantially equal to each other.

In the first aspect of the invention, control is performed in the flow ratio controller (72) and the superheat degree controller (71) in the evaporation mode of the heat-source-side heat exchanger (40). In the flow ratio controller (72), the flow ratio of refrigerant flowing through the heat exchange parts (50, 55) is controlled such that the temperature of refrigerant having passed through the main heat exchange part (50) and the temperature of refrigerant having passed through the auxiliary heat exchange part (55) before joining of such refrigerant are substantially equal to each other. On the other hand, in the superheat degree controller (71), the opening degree of the expansion valve (33) is controlled such that the superheat degree of refrigerant whose flows are joined together reaches the predetermined superheat degree. Such control allows refrigerant flowing through each heat exchange part (50, 55) to be in a superheat state (i.e., the state in which the superheat degree is close to the predetermined superheat degree). Thus, in each heat exchange part (50, 55), particularly in the auxiliary heat exchange part (55) into which more liquid refrigerant unevenly flows, an excessive decrease in refrigerant temperature is reduced or prevented, and therefore frost formation on the auxiliary heat exchange part (55) is reduced.

In the case where more liquid refrigerant unevenly flows into the auxiliary heat exchange part (55), the temperature of refrigerant on an outlet side of the auxiliary heat exchange part (55) is likely to decrease. Thus, in the flow ratio controller (72), the flow ratio is controlled such that a decrease in refrigerant temperature of the auxiliary heat exchange part (55) is reduced. Specifically, the flow ratio is controlled such that the flow volume of refrigerant of the auxiliary heat exchange part (55) decreases and that the flow volume of refrigerant of the main heat exchange part (50) increases. In the auxiliary heat exchange part (55), when the flow volume of refrigerant decreases, the amount of liquid refrigerant decreases, and a pressure loss is reduced. Thus, in the auxiliary heat exchange part (55), a decrease in pressure of refrigerant on the outlet side is reduced, and a decrease in refrigerant temperature is reduced accordingly. Meanwhile, in the main heat exchange part (50), since the flow volume of refrigerant increases, the amount of liquid refrigerant increases, and an evaporation amount increases.

A second aspect of the invention is intended for the refrigerating apparatus of the first aspect of the invention, in which the refrigerant circuit (20) further includes an upper pipe (26) into which the refrigerant flows from the main heat exchange part (50) in the evaporation mode of the heat-source-side heat exchanger (40), a lower pipe (27) into which the refrigerant flows from the auxiliary heat exchange part (55) in the evaporation mode of the heat-source-side heat exchanger (40), and a junction pipe (28) at which the refrigerant flowing through the upper pipe (26) and the refrigerant flowing through the lower pipe (27) are joined together in the evaporation mode of the heat-source-side heat exchanger (40), and the flow ratio adjustment mechanism is provided in the lower pipe (27), and includes a flow volume adjustment valve (66, 67) configured to adjust a flow volume of the refrigerant flowing through the lower pipe (27).

In the second aspect of the invention, the flow volume adjustment valve (66, 67) is provided in the lower pipe (27). The flow volume of refrigerant flowing through the lower pipe (27) is decreased by the flow volume adjustment valve (66, 67). Accordingly, the flow volume of refrigerant of the auxiliary heat exchange part (55) decreases, and the flow volume of refrigerant of the main heat exchange part (50) increases. Conversely, when the flow volume of refrigerant flowing through the lower pipe (27) is increased by the flow volume adjustment valve (66), the flow volume of refrigerant of the auxiliary heat exchange part (55) increases, and the flow volume of refrigerant of the main heat exchange part (50) decreases.

A third aspect of the invention is intended for the refrigerating apparatus of the first or second aspect of the invention, in which, of the heat transfer pipes, heat transfer pipes (58) provided in the auxiliary heat exchange part (55) is fewer than heat transfer pipes (53) provided in the main heat exchange part (50).

In the third aspect of the invention, since the number of heat transfer pipes (53, 58) of the auxiliary heat exchange part (55) is lower, gas refrigerant is less likely to flow into the auxiliary heat exchange part (55), and the proportion of liquid refrigerant in refrigerant flowing into the auxiliary heat exchange part (55) is high. Thus, the refrigerant temperature significantly decreases in the auxiliary heat exchange part (55), and it is more likely that frost is formed on the auxiliary heat exchange part (55). However, even in this case, a decrease in refrigerant temperature of the auxiliary heat exchange part (55) is reduced by the control using the flow ratio controller (72) and the superheat degree controller (71).

Advantages of the Invention

According to the present disclosure, the flow ratio controller (72) controls, in the evaporation mode of the heat-source-side heat exchanger (40), the flow ratio of refrigerant of the heat exchange parts (50, 55) such that the temperature of refrigerant having passed through the main heat exchange part (50) and the temperature of refrigerant having passed through the auxiliary heat exchange part (55) before joining of such refrigerant are substantially equal to each other. Moreover, the superheat degree controller (71) controls the opening degree of the expansion valve (33) such that the superheat degree of refrigerant whose flows are joined together reaches the predetermined superheat degree. Such control allows refrigerant flowing through each heat exchange part (50, 55) to be in the superheat state (i.e., the state in which the superheat degree is close to the predetermined superheat degree). Thus, in each heat exchange part (50, 55), particularly in the auxiliary heat exchange part (55) into which more liquid refrigerant unevenly flows, an excessive decrease in refrigerant temperature is reduced or prevented, and therefore frost formation on the auxiliary heat exchange part (55) can be reduced.

Specifically, in the case where more liquid refrigerant unevenly flows into the auxiliary heat exchange part (55) and the temperature of refrigerant of the auxiliary heat exchange part (55) decreases, the flow ratio controller (72) controls the flow ratio such that the flow volume of refrigerant of the auxiliary heat exchange part (55) decreases and that the flow volume of refrigerant of the main heat exchange part (50) increases. Thus, in the auxiliary heat exchange part (55), a decrease in refrigerant temperature is reduced, and therefore frost formation on the auxiliary heat exchange part (55) can be reduced. Accordingly, lowering of a heat exchange efficiency can be reduced. Meanwhile, in the main heat exchange part (50), since the amount of liquid refrigerant increases, the evaporation amount of refrigerant increases. As just described, an evaporative capacity of the heat-source-side heat exchanger (40) can be improved by reduction in lowering of the heat exchange efficiency of the auxiliary heat exchange part (55) and an increase in evaporation amount of refrigerant of the main heat exchange part (50).

According to the second aspect of the invention, the flow volume adjustment valve (66, 67) serving as the flow ratio adjustment mechanism is provided in the lower pipe (27) into which refrigerant flows from the auxiliary heat exchange part (55) in the evaporation mode of the heat-source-side heat exchanger (40). Thus, the refrigerant flow volume of the auxiliary heat exchange part (55) can be controlled with high accuracy, and it can be ensured that frost formation on the auxiliary heat exchange part (55) is reduced.

According to the third aspect of the invention, the number of heat transfer pipes (58) of the auxiliary heat exchange part (55) is less than the number of heat transfer pipes (53) of the main heat exchange part (50). If the heat transfer pipes (58) of the auxiliary heat exchange part (55) are fewer, the degree of unevenness of a refrigerant flow increases. Thus, in the auxiliary heat exchange part (55), the temperature of refrigerant further decreases, and therefore it is more likely that frost is formed on the auxiliary heat exchange part (55). However, even in this case, the control by the flow ratio controller (72) and the superheat degree controller (71) can reduce an excessive decrease in refrigerant temperature, and therefore it can be ensured that frost formation on the auxiliary heat exchange part (55) is reduced.

DESCRIPTION OF EMBODIMENTS

Embodiments of the present disclosure will be described below in detail with reference to drawings. Note that the embodiments described below will be set forth merely for the purpose of preferred examples in nature, and are not intended to limit the scope, applications, and use of the invention.

Embodiment of the Invention

An embodiment of the present disclosure will be described. The present embodiment is intended for an air conditioner (10) which is a refrigerating apparatus.

<Entire Configuration of Air Conditioner>

Figure 1:
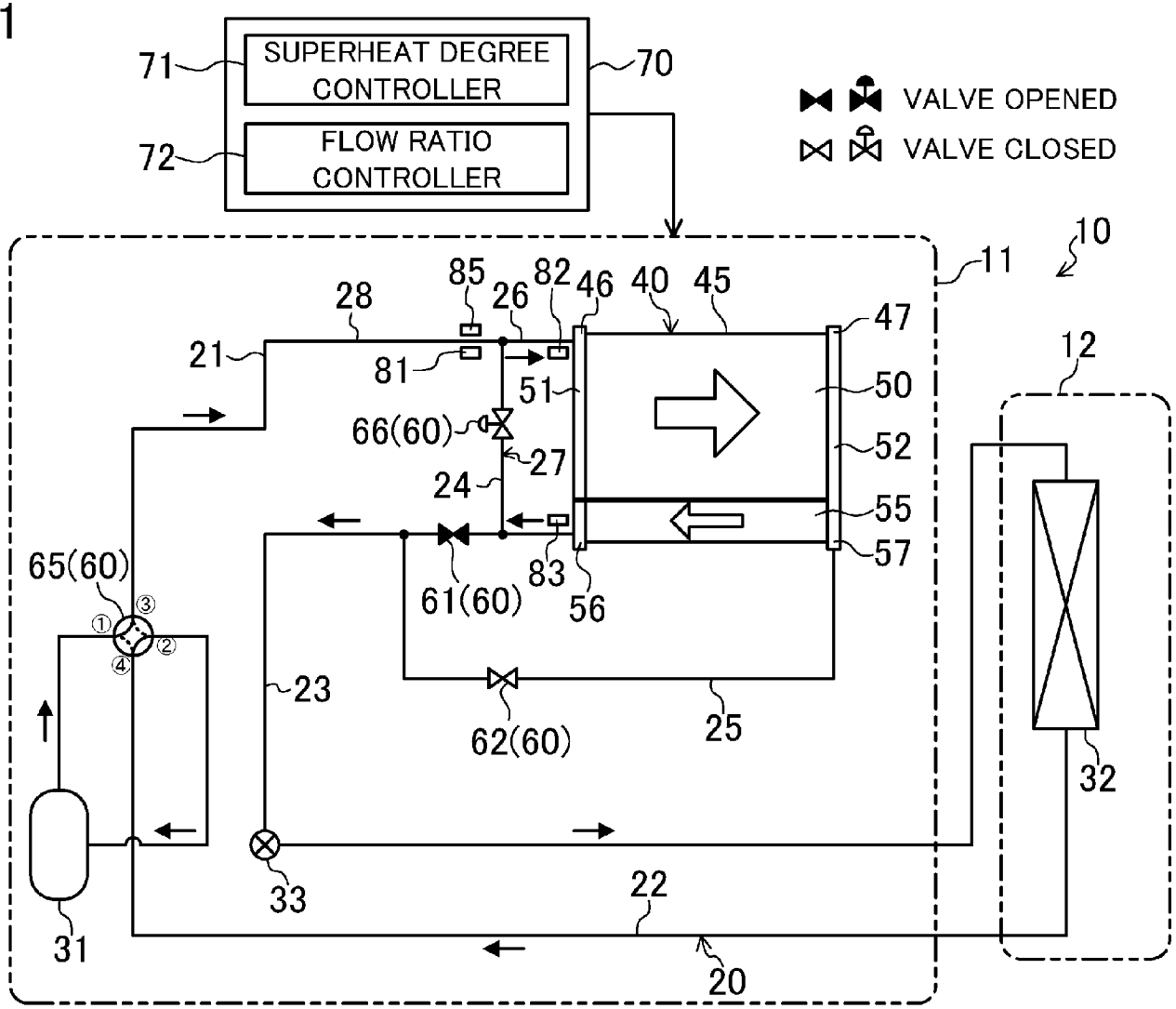
FIG. 1 is a refrigerant circuit diagram illustrating the state of an air conditioner of an embodiment in an air-cooling operation.

Referring to FIG. 1, the air conditioner (10) of the present embodiment includes an indoor unit (12), an outdoor unit (11), and a controller (70). In the air conditioner (10), the outdoor unit (11) and the indoor unit (12) are connected together by pipes to form a refrigerant circuit (20).

A compressor (31), an outdoor heat exchanger (40) serving as a heat-source-side heat exchanger, an indoor heat exchanger (32) serving as a utilization-side heat exchanger, an expansion valve (33), and a four-way valve (65) are connected together in the refrigerant circuit (20). The compressor (31), the outdoor heat exchanger (40), the expansion valve (33), and the four-way valve (65) are housed in the outdoor unit (11). The indoor heat exchanger (32) is housed in the indoor unit (12). Although not shown in the figure, an outdoor fan configured to supply outdoor air to the outdoor heat exchanger (40) is provided in the outdoor unit (11), and an indoor fan configured to supply indoor air to the indoor heat exchanger (32) is provided in the indoor unit (12).

The compressor (31) is a hermetic rotary compressor (31) or a hermetic scroll compressor (31). In the refrigerant circuit (20), a discharge pipe of the compressor (31) is connected to a later-described first port of the four-way valve (65) through a pipe, and a suction pipe of the compressor (31) is connected to a later-described second port of the four-way valve (65) through a pipe.

The four-way valve (65) is configured to switch a refrigerant circulation direction in the refrigerant circuit (20) depending on operations (i.e., an air-cooling operation or an air-heating operation). When the refrigerant circulation direction in the refrigerant circuit (20) is switched, e.g., operation of the outdoor heat exchanger (40) is switched from an evaporation mode to a condensation mode (or from the condensation mode to the evaporation mode). That is, the four-way valve (65) switches the mode of the outdoor heat exchanger (40) between the evaporation mode and the condensation mode, and forms part of a switching mechanism (60) of the present disclosure. The four-way valve (65) includes four ports. The four-way valve (65) switches between a first state (i.e., the state illustrated in FIG. 1) in which the first port communicates with a third port and the second port communicates with a fourth port and a second state (i.e., the state illustrated in FIG. 2) in which the first port communicates with the fourth port and the second port communicates with the third port.

The outdoor heat exchanger (40) is configured to exchange heat between refrigerant and outdoor air. The structure of the outdoor heat exchanger (40) will be described in detail later.

The indoor heat exchanger (32) is configured to exchange heat between refrigerant and indoor air. The indoor heat exchanger (32) is a so-called "cross-fin type fin-and-tube heat exchanger."

The expansion valve (33) is provided between the outdoor heat exchanger (40) and the indoor heat exchanger (32) in the refrigerant circuit (20). The expansion valve (33) is an electronic expansion valve configured to adjust an opening degree thereof to expand refrigerant (i.e., reduce the pressure of refrigerant). The opening degree of the expansion valve (33) is controlled by a later-described superheat degree controller (71) of the controller (70).

A first gas pipe (21), a second gas pipe (22), and a liquid pipe (23) are provided in the refrigerant circuit (20). The first gas pipe (21) is, at one end thereof, connected to the third port of the four-way valve (65), and is, at the other end thereof, connected to an upper end part of a later-described first header member (46) of the outdoor heat exchanger (40). The second gas pipe (22) is, at one end thereof, connected to the fourth port of the four-way valve (65), and is, at the other end thereof, connected to a gas end of the indoor heat exchanger (32). The liquid pipe (23) is, at one end thereof, connected to a lower end part of the later-described first header member (46) of the outdoor heat exchanger (40), and is, at the other end thereof, connected to a liquid end of the indoor heat exchanger (32). A first solenoid valve (61) and the expansion valve (33) are provided in the middle of the liquid pipe (23) in this order from a side close to the first header member (46) of the outdoor heat exchanger (40).

A gas connection pipe (24) and a liquid connection pipe (25) are provided in the refrigerant circuit (20). The gas connection pipe (24) is, at one end thereof, connected to part of the liquid pipe (23) between the first header member (46) and the first solenoid valve (61), and is, at the other end thereof, connected to the first gas pipe (21). The liquid connection pipe (25) is, at one end thereof, connected to part of the liquid pipe (23) between the first solenoid valve (61) and the expansion valve (33), and is, at the other end thereof, connected to a lower end part of a later-described second header member (47) of the outdoor heat exchanger (40). A flow volume adjustment valve (66) is provided in the middle of the gas connection pipe (24), and a second solenoid valve (62) is provided in the middle of the liquid connection pipe (25).

The first solenoid valve (61), the second solenoid valve (62), and the flow volume adjustment valve (66) are each configured to switch between an open state and a closed state depending on the modes (i.e., the condensation mode and the evaporation mode) of the outdoor heat exchanger (40) to switch refrigerant circulation in the outdoor heat exchanger (40). The first solenoid valve (61), the second solenoid valve (62), and the flow volume adjustment valve (66) form part of the switching mechanism (60) of the present disclosure. Specifically, in the condensation mode of the outdoor heat exchanger (40), theses three valves (61, 62, 66) are configured such that the first solenoid valve (61) is opened and that the second solenoid valve (62) and the flow volume adjustment valve (66) are closed (see the state illustrated in FIG. 1). In the evaporation mode of the outdoor heat exchanger (40), these three valves (61, 62, 66) are configured such that the first solenoid valve (61) is closed and that the second solenoid valve (62) and the flow volume adjustment valve (66) are opened (see the state illustrated in FIG. 2).

The flow volume adjustment valve (66) is configured not only to switch between the open state and the closed state, but also to adjust, in the evaporation mode of the outdoor heat exchanger (40), an opening degree thereof to adjust the flow volume of refrigerant flowing through the gas connection pipe (24). A change in flow volume of refrigerant flowing through the gas connection pipe (24) results in a change in flow ratio of refrigerant flowing through later-described two heat exchange parts (50, 55) of the outdoor heat exchanger (40). That is, the flow volume adjustment valve (66) is for adjusting the flow ratio, and also serves as a flow ratio adjustment mechanism of the present disclosure.

A first temperature sensor (81), a second temperature sensor (82), and a first pressure sensor (85) are provided in the first gas pipe (21). The first temperature sensor (81) and the first pressure sensor (85) are provided close to the four-way valve (65) relative to a connection part between the first gas pipe (21) and the gas connection pipe (24). On the other hand, the second temperature sensor (82) is provided close to the outdoor heat exchanger (40) relative to the connection part between the first gas pipe (21) and the gas connection pipe (24). A third temperature sensor (83) is provided in the liquid pipe (23). The third temperature sensor (83) is provided close to the outdoor heat exchanger (40) relative to a connection part between the liquid pipe (23) and the gas connection pipe (24).

<Configuration of Outdoor Heat Exchanger>

The structure of the outdoor heat exchanger (40) will be described in detail with reference to FIGS. 4-6. The outdoor heat exchanger (40) of the present embodiment includes a single heat exchanger unit (45).

Figure 4:
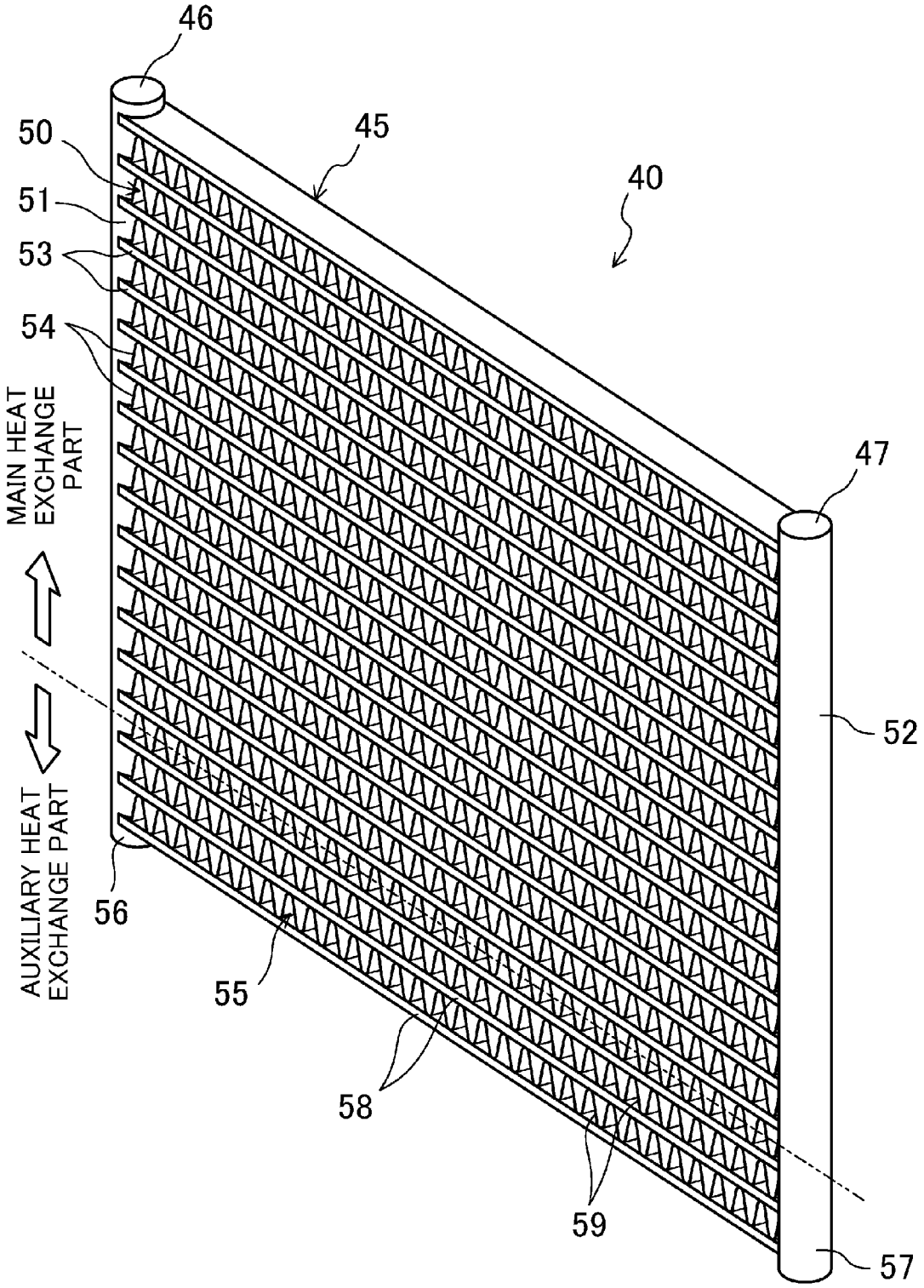
FIG. 4 is a schematic perspective view of an outdoor heat exchanger of the embodiment.
Figure 5:
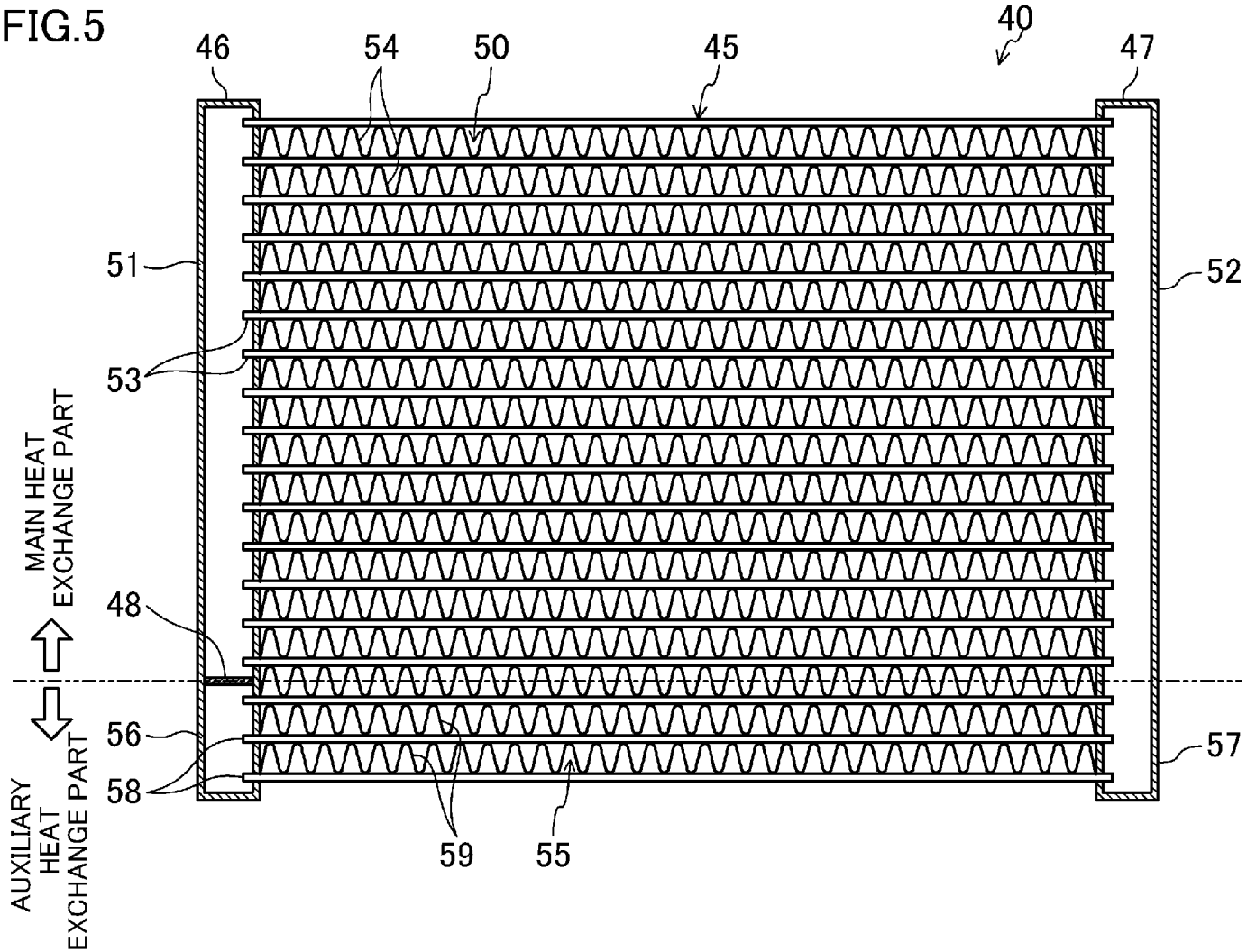
FIG. 5 is a schematic front view of the outdoor heat exchanger of the embodiment.

Referring to FIGS. 4 and 5, the heat exchanger unit (45) forming the outdoor heat exchanger (40) includes the single first header member (46), the single second header member (47), a plurality of heat transfer pipes (53, 58), and a plurality of fins (54, 59). The first header member (46), the second header member (47), the heat transfer pipes (53, 58), and the fins (54, 59) are members made of an aluminum alloy, and are joined together by brazing.

The first header member (46) and the second header member (47) are each formed in an elongated hollow cylindrical shape closed at both end. Referring to FIG. 5, the first header member (46) is provided so as to stand at a left end of the heat exchanger unit (45), and the second header member (47) is provided so as to stand at a right end of the heat exchanger unit (45). That is, the first header member (46) and the second header member (47) are each placed in such an attitude that an axial direction thereof is along the vertical direction.

Figure 6:
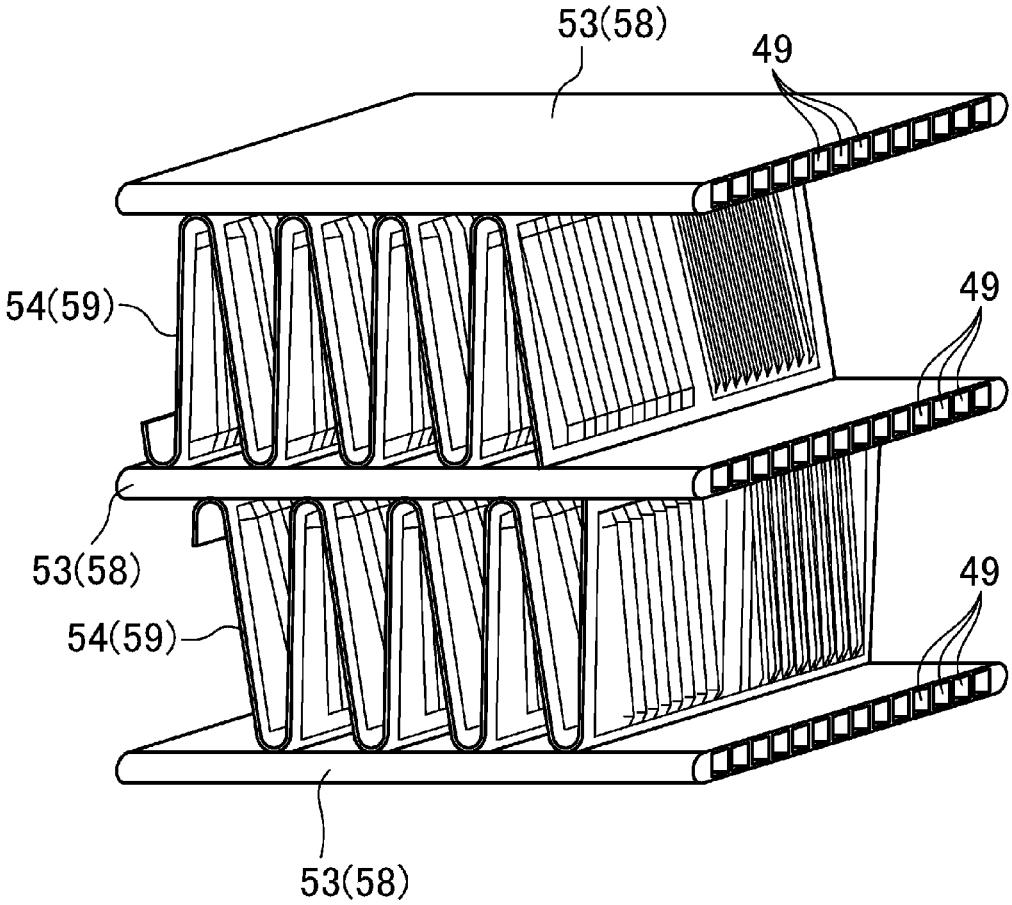
FIG. 6 is an enlarged partial perspective view of a main part of the outdoor heat exchanger of the embodiment.

Referring to FIG. 6, each heat transfer pipe (53, 58) is formed in a flat shape, and a plurality of refrigerant flow paths (49) are formed in line in each heat transfer pipe (53, 58). The heat transfer pipes (53, 58) are arranged in the vertical direction at predetermined intervals such that an axial direction thereof is along the horizontal direction and that side surfaces thereof face each other. Each heat transfer pipe (53, 58) is, at one end thereof, connected to the first header member (46), and, at the other end thereof, connected to the second header member (47). Each refrigerant flow path (49) in the heat transfer pipes (53, 58) communicates, at one end thereof, with an internal space of the first header member (46), and communicates, at the other end thereof, with an internal space of the second header member (47).

Each fin (54, 59) is joined between adjacent ones of the heat transfer pipes (53, 58). Each fin (54, 59) is formed in a corrugated plate shape meandering up and down, and is placed in such an attitude that a ridge line of such a wave shape is along a front-back direction (i.e., a direction perpendicular to the plane of paper of FIG. 5) of the heat exchanger unit (45). In the heat exchanger unit (45), air passes in the direction perpendicular to the plane of paper of FIG. 5.

Referring to FIG. 5, a discoid partition plate (48) is provided in the first header member (46). The internal space of the first header member (46) is divided into upper and lower spaces by the partition plate (48). On the other hand, the internal space of the second header member (47) is an undivided single space.

An upper part of the heat exchanger unit (45) relative to the partition plate (48) forms the main heat exchange part (50), and a lower part of the heat exchanger unit (45) relative to the partition plate (48) forms the auxiliary heat exchange part (55).

Specifically, in the first header member (46), the upper part relative to the partition plate (48) forms a first header (51) of the main heat exchange part (50), and the lower part relative to the partition plate (48) forms a first header (56) of the auxiliary heat exchange part (55). Of the heat transfer pipes (53, 58) provided in the heat exchanger unit (45), the heat transfer pipes (53) connected to the first header (51) of the main heat exchange part (50) are for the main heat exchange part (50), and the heat transfer pipes (58) connected to the first header (56) of the auxiliary heat exchange part (55) are for the auxiliary heat exchange part (55). Of the fins (54, 59) provided in the heat exchanger unit (45), the fins (54) each provided between adjacent ones of the heat transfer pipes (53) of the main heat exchange part (50) are for the main heat exchange part (50), and the fins (59) each provided between adjacent ones of the heat transfer pipes (58) of the auxiliary heat exchange part (55) are for the auxiliary heat exchange part (55). Part of the second header member (47) connected to the heat transfer pipes (53) of the main heat exchange part (50) forms a second header (52) of the main heat exchange part (50), and the remaining part of the second header member (47) connected to the heat transfer pipes (58) of the auxiliary heat exchange part (55) forms a second header (57) of the auxiliary heat exchange part (55).

In the outdoor heat exchanger (40) of the present embodiment, the number of heat transfer pipes (58) of the auxiliary heat exchange part (55) is lower than the number of heat transfer pipes (53) of the main heat exchange part (50). Specifically, the number of heat transfer pipes (58) of the auxiliary heat exchange part (55) is about ⅙ of the number of heat transfer pipes (53) of the main heat exchange part (50). Note that the number of heat transfer pipes (53, 58) illustrated in FIGS. 4 and 5 is different from the actual number of heat transfer pipes (53, 58) provided in the outdoor heat exchanger (40).

As described above, the first gas pipe (21), the liquid pipe (23), and the liquid connection pipe (25) are connected respectively to the upper end part of the first header member (46), the lower end part of the first header member (46), and the lower end part of the second header member (47) (see FIG. 1). That is, in the outdoor heat exchanger (40), the first gas pipe (21), the liquid pipe (23), and the liquid connection pipe (25) are connected respectively to the first header (51) of the main heat exchange part (50), the first header (56) of the auxiliary heat exchange part (55), and the second header (57) of the auxiliary heat exchange part (55).

In the condensation mode of the outdoor heat exchanger (40), the first solenoid valve (61) is opened, and the second solenoid valve (62) and the flow volume adjustment valve (66) are closed. Accordingly, the main heat exchange part (50) and the auxiliary heat exchange part (55) are connected together in series. Upon serial connection, refrigerant flows from the first gas pipe (21) to the first header (51) of the main heat exchange part (50), and passes through the main heat exchange part (50) and the auxiliary heat exchange part (55) in this order. Then, the refrigerant flows out from the first header (56) of the auxiliary heat exchange part (55) to the liquid pipe (23).

In the evaporation mode of the outdoor heat exchanger (40), the first solenoid valve (61) is closed, and the second solenoid valve (62) and the flow volume adjustment valve (66) are opened. Accordingly, the main heat exchange part (50) and the auxiliary heat exchange part (55) are connected together in parallel. Upon parallel connection, refrigerant flows from the liquid connection pipe (25) to the second header (57) of the auxiliary heat exchange part (55), and passes through each heat exchange part (50, 55) so as to branch into the main heat exchange part (50) and the auxiliary heat exchange part (55). After passing through the main heat exchange part (50), the refrigerant flows out from the first header (51) of the main heat exchange part (50) to the first gas pipe (21). Meanwhile, after passing through the auxiliary heat exchange part (55), the refrigerant flows out from the first header (56) of the auxiliary heat exchange part (55) to the liquid pipe (23), and then flows into the gas connection pipe (24). The refrigerant having passed through the main heat exchange part (50) and the refrigerant having passed through the auxiliary heat exchange part (55) are joined together at the connection part (hereinafter referred to as a "junction") between the first gas pipe (21) and the gas connection pipe (24). Then, the refrigerant flows into the four-way valve (65). Part of the first gas pipe (21) extending from the first header (51) of the main heat exchange part (50) to the junction forms an upper pipe (26) of the present disclosure into which refrigerant flows from the main heat exchange part (50). Of the liquid pipe (23) and the gas connection pipe (24), part extending from the first header (56) of the auxiliary heat exchange part (55) to the junction forms a lower pipe (27) of the present disclosure into which refrigerant flows from the auxiliary heat exchange part (55). Part of the first gas pipe (21) extending from the junction to the four-way valve (65) forms a junction pipe (28) of the present disclosure at which refrigerant from the upper pipe (26) and refrigerant from the lower pipe (27) are joined together.

<Controller>

The controller (70) is configured to control driving of the compressor (31), switching of the four-way valve (65), opening/closing of the three valves (61, 62, 66), and the opening degrees of the expansion valve (33) and the flow volume adjustment valve (66). The controller (70) includes the superheat degree controller (71) and a flow ratio controller (72).

The superheat degree controller (71) is configured to control the opening degree of the expansion valve (33) in the evaporation mode of the outdoor heat exchanger (40). The opening degree of the expansion valve (33) is controlled such that the superheat degree of refrigerant whose flows are joined together after passing through the main heat exchange part (50) and the auxiliary heat exchange part (55) has a predetermined superheat degree. The superheat degree of refrigerant whose flows are joined together after passing through the heat exchange parts (50, 55) is obtained from a refrigerant temperature measured by the first temperature sensor (81) and a refrigerant pressure measured by the first pressure sensor (85).

The flow ratio controller (72) is configured to control the opening degree of the flow volume adjustment valve (66) in the evaporation mode of the outdoor heat exchanger (40). The opening degree of the flow volume adjustment valve (66) is controlled such that the temperature of refrigerant having passed through the main heat exchange part (50) and the temperature of refrigerant having passed through the auxiliary heat exchange part (55) are substantially equal to each other. The temperature of refrigerant having passed through the main heat exchange part (50) is measured by the second temperature sensor (82), and the temperature of refrigerant having passed through the auxiliary heat exchange part (55) is measured by the third temperature sensor (83).

Operations

The operations of the air conditioner (10) will be described. The air conditioner (10) performs the air-cooling operation in which the outdoor heat exchanger (40) functions as a condenser and the indoor heat exchanger (32) functions as an evaporator, and the air-heating operation in which the outdoor heat exchanger (40) functions as the evaporator and the indoor heat exchanger (32) functions as the condenser. In the air-heating operation, the air conditioner (10) performs a defrosting mode for melting frost formed on the outdoor heat exchanger (40).

<Air-Cooling Operation>

A process in the air-cooling operation of the air conditioner (10) will be described with reference to FIG. 1.

In the air-cooling operation, the four-way valve (65) is set to the first state. Moreover, the main heat exchange part (50) and the auxiliary heat exchange part (55) are connected together in series in the state in which the first solenoid valve (61) is opened and that the second solenoid valve (62) and the flow volume adjustment valve (66) are closed.

In the refrigerant circuit (20), refrigerant discharged from the compressor (31) passes through the four-way valve (65) and the first gas pipe (21) in this order, and then flows into the first header (51) of the main heat exchange part (50). The refrigerant flowing into the first header (51) flows so as to branch into the heat transfer pipes (53) of the main heat exchange part (50). While passing through each refrigerant flow path (49) of the heat transfer pipes (53), the refrigerant is condensed by dissipating heat to outdoor air. Flows of the refrigerant having passed through the heat transfer pipes (53) are joined together at the second header (52) of the main heat exchange part (50), and then such refrigerant flows down to the second header (57) of the auxiliary heat exchange part (55). The refrigerant flowing into the second header (57) flows so as to branch into the heat transfer pipes (58) of the auxiliary heat exchange part (55). While passing through each refrigerant flow path (49) of the heat transfer pipes (58), the refrigerant enters a subcooling state by dissipating heat to outdoor air. Flows of the refrigerant having passed through the heat transfer pipes (58) are joined together at the first header (56) of the auxiliary heat exchange part (55).

The refrigerant flowing out from the first header (56) of the auxiliary heat exchange part (55) to the liquid pipe (23) is expanded (i.e., the pressure of the refrigerant is reduced) while passing through the expansion valve (33), and then flows into the liquid end of the indoor heat exchanger (32). The refrigerant flowing into the indoor heat exchanger (32) is evaporated by absorbing heat from indoor air. The indoor unit (12) sucks indoor air and supplies the indoor air to the indoor heat exchanger (32). Then, the indoor air cooled in the indoor heat exchanger (32) is sent back to the inside of a room.

The refrigerant evaporated in the indoor heat exchanger (32) flows out to the second gas pipe (22) through the gas end of the indoor heat exchanger (32). Subsequently, the refrigerant is sucked into the compressor (31) through the four-way valve (65). The compressor (31) compresses the sucked refrigerant and discharges the compressed refrigerant.

<Air-Heating Operation>

Figure 2:
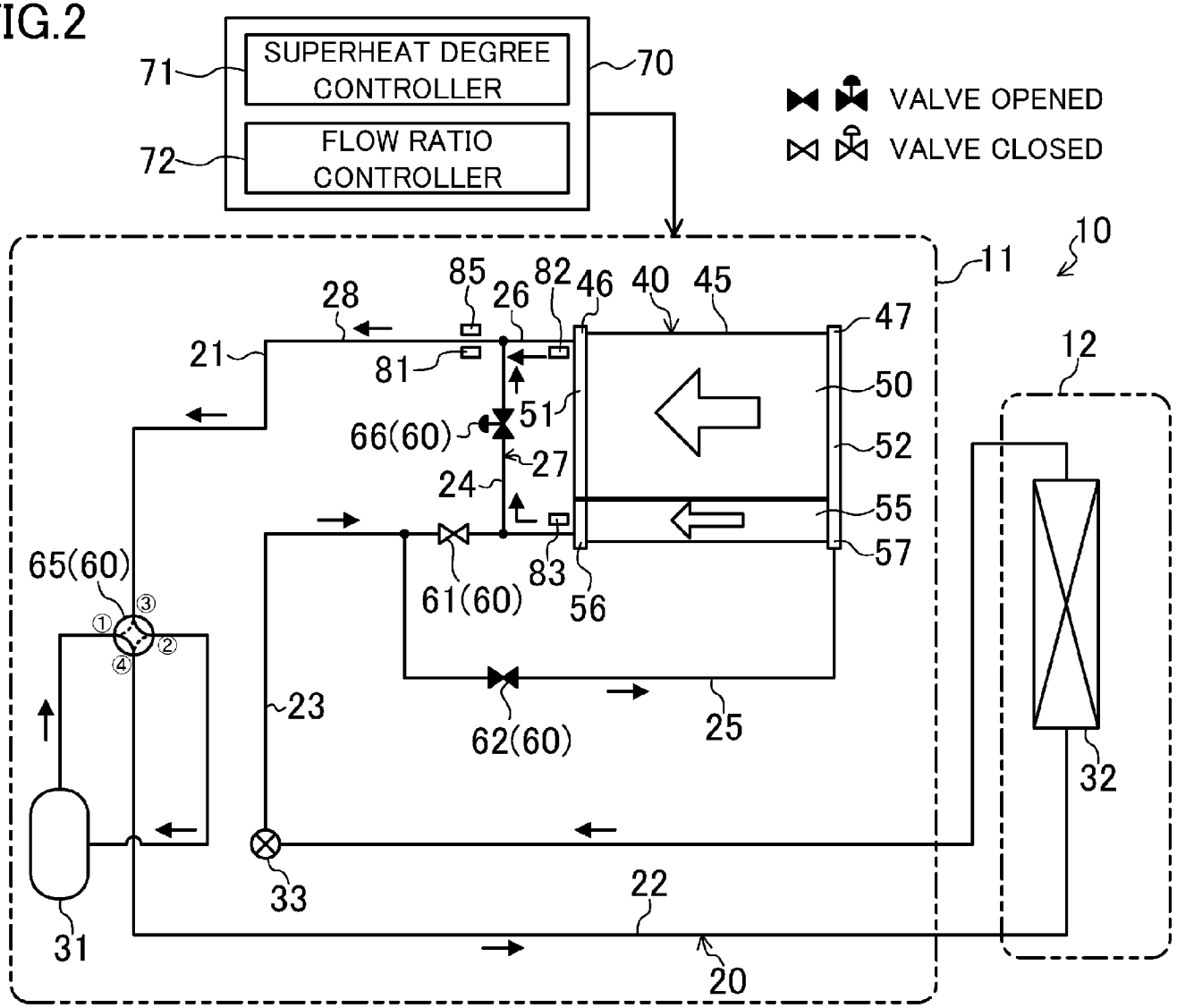
FIG. 2 is a refrigerant circuit diagram illustrating the state of the air-conditioner of the embodiment in an air-heating operation.

A process in the air-heating operation of the air conditioner (10) will be described with reference to FIG. 2.

In the air-heating operation, the four-way valve (65) is set to the second state. Moreover, the main heat exchange part (50) and the auxiliary heat exchange part (55) are connected together in parallel in the state in which the first solenoid valve (61) is closed and that the second solenoid valve (62) and the flow volume adjustment valve (66) are opened.

In the refrigerant circuit (20), refrigerant discharged from the compressor (31) passes through the four-way valve (65) and the second gas pipe (22) in this order, and then flows into the gas end of the indoor heat exchanger (32). The refrigerant flowing into the indoor heat exchanger (32) is condensed by dissipating heat to indoor air. The indoor unit (12) sucks indoor air and supplies the indoor air to the indoor heat exchanger (32). Then, the indoor air heated in the indoor heat exchanger (32) is sent back to the inside of the room.

The refrigerant flowing out to the liquid pipe (23) through the liquid end of the indoor heat exchanger (32) is expanded (i.e., the pressure of the refrigerant is reduced) while passing through the expansion valve (33). Subsequently, the refrigerant passes through the liquid connection pipe (25), and then flows into the second header (57) of the auxiliary heat exchange part (55) of the outdoor heat exchanger (40). The second header (57) of the auxiliary heat exchange part (55) communicates with the second header (57) of the main heat exchange part (50). Thus, part of the refrigerant flowing into the second header (57) of the auxiliary heat exchange part (55) flows so as to branch into the heat transfer pipes (58) of the auxiliary heat exchange part (55), and the remaining part of the refrigerant flows from the second header (57) of the main heat exchange part (50) so as to branch into the heat transfer pipes (53). While passing through each refrigerant flow path (49), the refrigerant flowing into each heat transfer pipe (53, 58) is evaporated by absorbing heat from outdoor air.

Flows of the refrigerant having passed through the heat transfer pipes (53) of the main heat exchange part (50) are joined together at the first header (51) of the main heat exchange part (50), and then such refrigerant flows out to the first gas pipe (21). Meanwhile, flows of the refrigerant having passed through the heat transfer pipes (58) of the auxiliary heat exchange part (55) are joined together at the first header (56) of the auxiliary heat exchange part (55), and then such refrigerant flows out to the liquid pipe (23). The refrigerant flowing into the liquid pipe (23) passes through the gas connection pipe (24), and then joins the refrigerant having passed through the main heat exchange part (50) at the junction. The joined refrigerant is sucked into the compressor (31) after passing through the four-way valve (65). The compressor (31) compresses the sucked refrigerant and discharges the compressed refrigerant.

In the air-heating operation (i.e., the evaporation mode of the outdoor heat exchanger (40)), refrigerant flowing from the liquid connection pipe (25) to the second header (57) of the auxiliary heat exchange part (55) is in a gas-liquid two-phase state. Thus, the liquid refrigerant having a higher specific gravity is more likely to flow into the auxiliary heat exchange part (55) provided on the lower side, whereas the gas refrigerant having a lower specific gravity is more likely to flow into the main heat exchange part (50) provided on the upper side. In the case where more liquid refrigerant flows into the auxiliary heat exchange part (55) due to an uneven flow of refrigerant, a pressure loss is greater in the auxiliary heat exchange part (55) as compared to the case where no uneven flow of refrigerant occurs. Thus, in the auxiliary heat exchange part (55), the pressure of refrigerant on an outlet side decreases due to a greater pressure loss, and the temperature of refrigerant decreases accordingly. As a result, it is likely that frost is formed on the auxiliary heat exchange part (55) due to over-cooling of surrounding air. Meanwhile, in the main heat exchange part (50), the flow volume of the liquid refrigerant decreases because more liquid refrigerant flows into the auxiliary heat exchange part (55). Thus, a sufficient evaporation amount cannot be ensured.

However, in the present embodiment, the following control is performed by the superheat degree controller (71) and the flow ratio controller (72).

<Control by Superheat Degree Controller>

Figure 7:
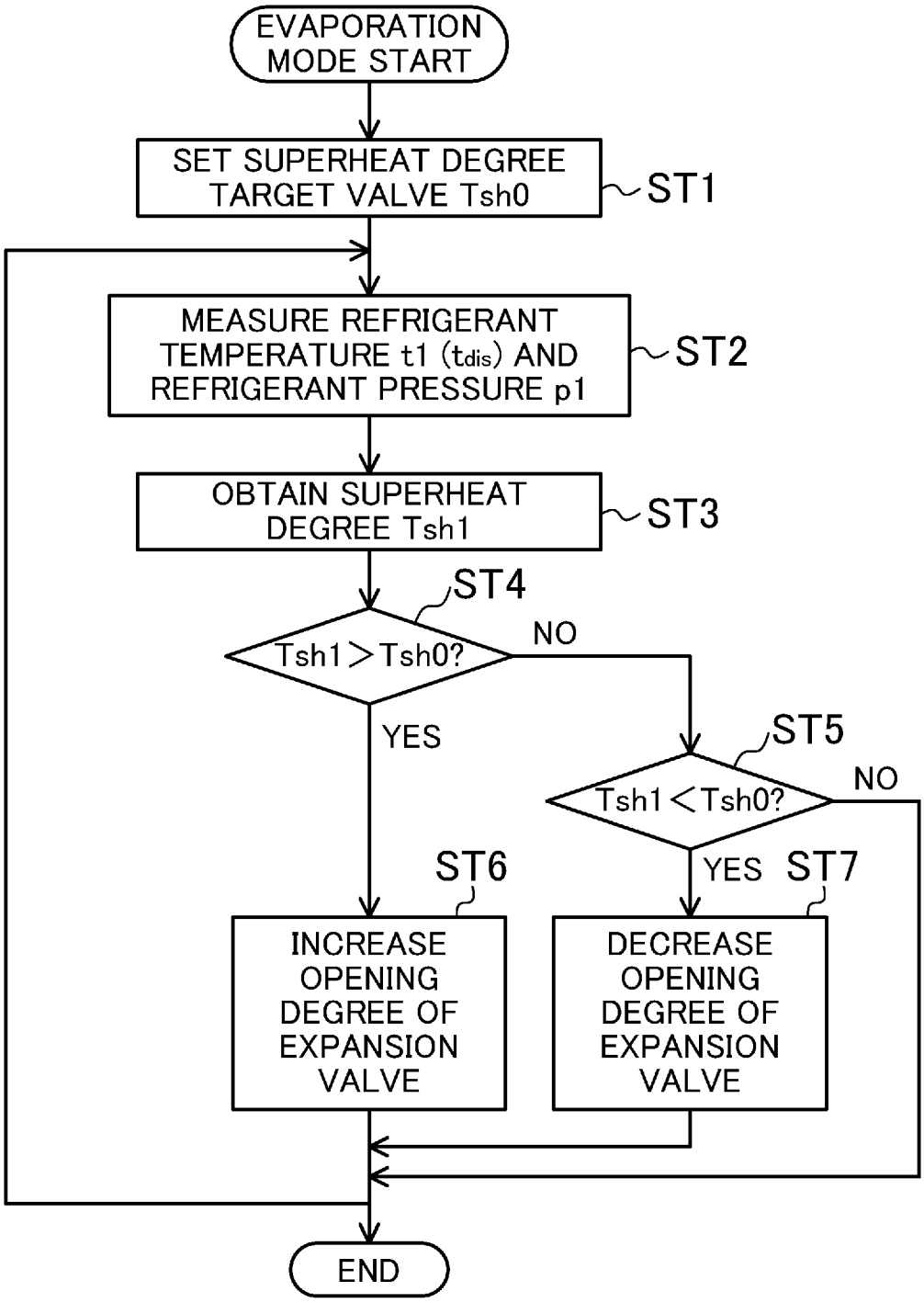
FIG. 7 is a flowchart showing a control by a superheat degree controller of the embodiment.

In the superheat degree controller (71), the opening degree of the expansion valve (33) is, referring to FIG. 7, controlled in the evaporation mode of the outdoor heat exchanger (40).

First, at step ST1, a target value Tsh0 (e.g., 5° C.) for superheat degree of refrigerant whose flows are joined together after passing through the heat exchange parts (50, 55) of the outdoor heat exchanger (40) is set.

Next, at step ST2, a temperature t1 and a pressure p1 of refrigerant (i.e., refrigerant on an inlet side of the compressor (31)) whose flows are joined together after passing through the heat exchange parts (50, 55) are measured. The temperature t1 and pressure p1 of refrigerant are measured respectively by the first temperature sensor (81) and the first pressure sensor (85).

Next, at step ST3, a superheat degree Tsh1 is obtained from the temperature t1 and pressure p1 of refrigerant. Specifically, the superheat degree Tsh1 is obtained by subtracting an equivalent saturation temperature ts1 of the pressure p1 of refrigerant from the temperature t1 of the refrigerant.

Next, at steps ST4, ST5, the superheat degree Tsh1 and the superheat degree target value Tsh0 are compared to each other.

First, at step ST4, it is determined whether or not the superheat degree Tsh1 is higher than the superheat degree target value Tsh0. If the superheat degree Tsh1 is higher than the superheat degree target value Tsh0, the process proceeds to step ST6. On the other hand, if the superheat degree Tsh1 is equal to or lower than the superheat degree target value Tsh0, the process proceeds to step ST5.

Next, at step ST5, it is determined whether or not the superheat degree Tsh1 is lower than the superheat degree target value Tsh0. If the superheat degree Tsh1 is lower than the superheat degree target value Tsh0, the process proceeds to step ST7. On the other hand, if the superheat degree Tsh1 is equal to the superheat degree target value Tsh0, the process returns to step ST2.

At step ST6, the opening degree of the expansion valve (33) is increased. If the opening degree of the expansion valve (33) increases, the flow volume of refrigerant flowing into the outdoor heat exchanger (40) through the expansion valve (33) increases, and therefore the superheat degree Tsh1 of refrigerant decreases. As just described, the opening degree of the expansion valve (33) is, at step ST6, controlled such that the superheat degree Tsh1 of refrigerant decreases. Then, the process returns to step ST2.

At step ST7, the opening degree of the expansion valve (33) is decreased. If the opening degree of the expansion valve (33) decreases, the flow volume of refrigerant flowing into the outdoor heat exchanger (40) through the expansion valve (33) decreases, and therefore the superheat degree Tsh1 of refrigerant increases. As just described, the opening degree of the expansion valve (33) is, at step ST7, controlled such that the superheat degree Tsh1 of refrigerant increases. Then, the process returns to step ST2.

As described above, in the superheat degree controller (71), the opening degree of the expansion valve (33) is controlled such that the superheat degree Tsh1 reaches the predetermined superheat degree Tsh0.

<Control by Flow Ratio Controller>

Figure 8:
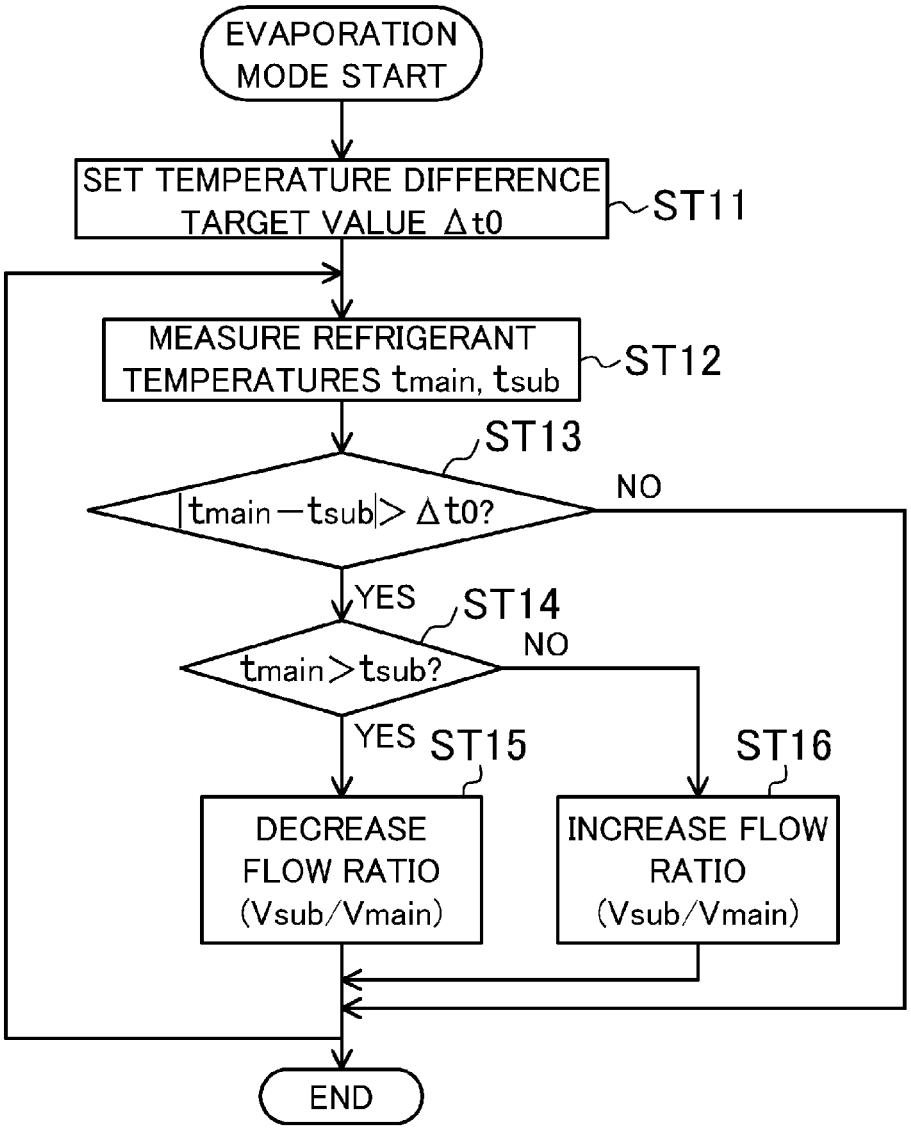
FIG. 8 is a flowchart showing a control by a flow ratio controller of the embodiment.

In the flow ratio controller (72), the opening degree of the flow volume adjustment valve (66) is, referring to FIG. 8, controlled in the evaporation mode of the outdoor heat exchanger (40).

First, at step ST11, a target value Δt0 (e.g., 1° C.) for difference between the temperature tmain of refrigerant having passed through the main heat exchange part (50) and the temperature tsub of refrigerant having passed through the auxiliary heat exchange part (55) is set.

Next, at step ST12, the temperature tmain of refrigerant having passed through the main heat exchange part (50) and the temperature tsub of refrigerant having passed through the main heat exchange part (50) are measured. The temperature tmain of refrigerant having passed through the main heat exchange part (50) is measured by the second temperature sensor (82), and the temperature tsub of refrigerant having passed through the auxiliary heat exchange part (55) is measured by the third temperature sensor (83).

Next, at step ST13, it is determined whether or not an absolute value for difference between the temperature tmain and the temperature tsub is greater than the temperature difference target value Δt0. If the absolute value for difference between the temperature tmain and the temperature tsub is greater than the temperature difference target value Δt0, the process proceeds to step ST14. On the other hand, if the absolute value for difference between the temperature tmain and the temperature tsub is less than the temperature difference target value Δt0, the process returns to step ST12.

Next, at step ST14, it is determined whether or not the temperature tmain is higher than the temperature tsub. If the temperature tmain is higher than the temperature tsub, the process proceeds to step ST15. On the other hand, if the temperature tmain is lower than the temperature tsub, the process proceeds to step ST16.

At step ST15, a flow ratio Vsub/Vmain is reduced. Specifically, the opening degree of the flow volume adjustment valve (66) is decreased to reduce a refrigerant flow volume Vsub of the auxiliary heat exchange part (55). Accordingly, a refrigerant flow volume Vmain of the main heat exchange part (50) increases by the reduction in refrigerant flow volume Vsub. In the auxiliary heat exchange part (55), when the refrigerant flow volume Vsub decreases, the amount of liquid refrigerant decreases. Thus, a compression loss is reduced. The reduction in compression loss allows an increase in pressure of refrigerant on the outlet side of the auxiliary heat exchange part (55), and the temperature tsub increases accordingly. Meanwhile, in the main heat exchange part (50), when the refrigerant flow volume Vmain increases, the amount of liquid refrigerant increases. Thus, a compression loss is increased. The increase in compression loss allows a decrease in pressure of refrigerant on an outlet side of the main heat exchange part (50), and the temperature tmain decreases accordingly. As just described, the flow ratio Vsub/Vmain is, at step ST15, controlled in such a manner that the difference between the temperature tsub and the temperature tmain is decreased by an increase in temperature tsub and a decrease in temperature tmain. Then, the process returns to step ST12.

At step ST16, the flow ratio Vsub/Vmain is increased. Specifically, the opening degree of the flow volume adjustment valve (66) is increased to increase the refrigerant flow volume Vsub of the auxiliary heat exchange part (55). The refrigerant flow volume Vmain of the main heat exchange part (50) decreases by the increase in refrigerant flow volume Vsub. In the auxiliary heat exchange part (55), when the refrigerant flow volume Vsub increases, the amount of liquid refrigerant increases. Thus, a compression loss is increased. The increase in compression loss allows a decrease in pressure of refrigerant on the outlet side of the auxiliary heat exchange part (55), and the temperature tsub decreases accordingly. Meanwhile, in the main heat exchange part (50), when the refrigerant flow volume Vmain decreases, the amount of liquid refrigerant decreases. Thus, a compression loss is reduced. The reduction in compression loss allows an increase in pressure of refrigerant on the outlet side of the main heat exchange part (50), and the temperature tmain increases accordingly. As just described, the flow ratio Vsub/Vmain is, at step ST16, controlled in such a manner that the difference between the temperature tsub and the temperature tmain is decreased by a decrease in temperature tsub and an increase in temperature tmain. Then, the process returns to step ST12.

In the flow ratio controller (72), the flow ratio Vsub/Vmain is controlled such that the absolute value for difference between the temperature tmain and temperature tsub is less than the target value Δt0. Thus, if the target value Δt0 is set to a value close to zero, the temperature tmain and the temperature tsub reach the substantially same temperature by the control using the flow ratio controller (72).

In the present embodiment, the control is performed in the superheat degree controller (71) and the flow ratio controller (72) such that the temperature tmain of refrigerant having passed through the main heat exchange part (50) and the temperature tsub of refrigerant having passed through the auxiliary heat exchange part (55) are substantially equal to each other before flows of such refrigerant are joined together and that the superheat degree Tsh1 of refrigerant after the flows of the refrigerant are joined together reaches the predetermined superheat degree Tsh0. From such a temperature state, it is expected that refrigerant flowing through each heat exchange part (50, 55) is in a superheat state (i.e., the state in which the superheat degree is close to the predetermined superheat degree Tsh0). Thus, in each heat exchange part (50, 55), particularly in the auxiliary heat exchange part (55) into which more liquid refrigerant unevenly flows, the refrigerant temperature is not sharply dropped, and frost formation on the auxiliary heat exchange part (55) is reduced. That is, in the present embodiment, refrigerant of the auxiliary heat exchange part (55) can be at such a temperature at which frost is not formed.

In the case where more liquid refrigerant unevenly flows into the auxiliary heat exchange part (55) and therefore the refrigerant temperature of the auxiliary heat exchange part (55) decreases, the flow ratio Vsub/Vmain is controlled in the flow ratio controller (72) such that the refrigerant flow volume Vmain of the main heat exchange part (50) increases. Thus, in the main heat exchange part (50), the amount of liquid refrigerant inflow increases, and the evaporation amount increases accordingly.

<Defrosting Mode>

When the air-heating operation is performed at a low outdoor air temperature (e.g., a temperature of equal to or lower than 0° C.), frost is formed on the outdoor heat exchanger (40) serving as the evaporator. Due to the frost formed on the outdoor heat exchanger (40), a flow of outdoor air passing through the outdoor heat exchanger (40) is blocked, and the heat absorption amount of refrigerant in the outdoor heat exchanger (40) decreases. Under operational conditions under which frost formation on the outdoor heat exchanger (40) is expected, the air conditioner (10) performs the defrosting mode, e.g., every time duration of the air-heating operation reaches a predetermined value (e.g., several minutes).

Figure 3:
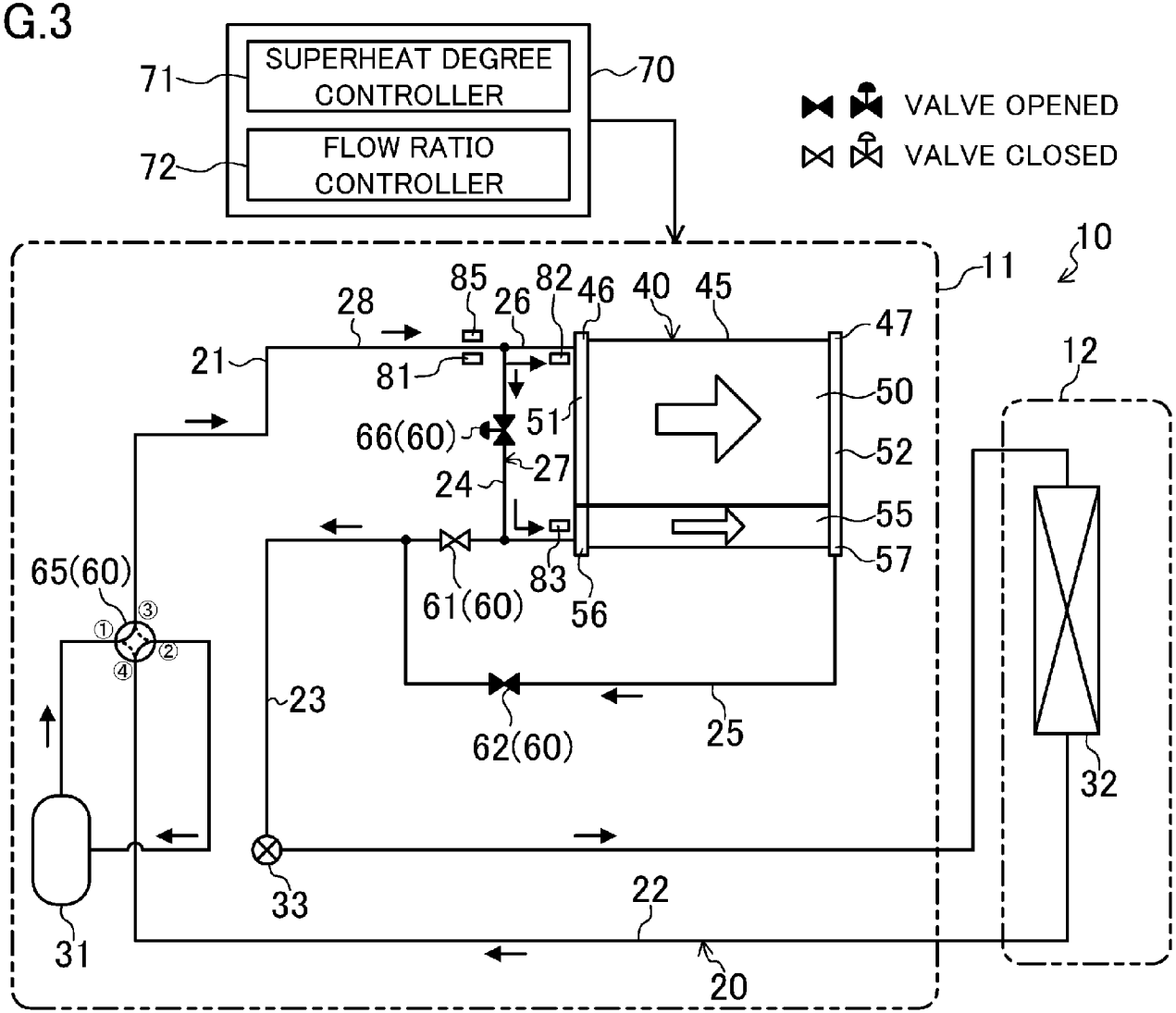
FIG. 3 is a refrigerant circuit diagram illustrating the state of the air conditioner of the embodiment in a defrosting mode.

A process in the defrosting mode of the air conditioner (10) will be described with reference to FIG. 3.

In the defrosting mode, the four-way valve (65) is set to the first state. Moreover, the main heat exchange part (50) and the auxiliary heat exchange part (55) are connected together in parallel in the state in which the first solenoid valve (61) is closed and that the second solenoid valve (62) and the flow volume adjustment valve (66) are opened. Unlike the air-heating operation, the flow volume adjustment valve (66) is held at a fully-opened state.

In the refrigerant circuit (20), refrigerant discharged from the compressor (31) flows into the first gas pipe (21) through the four-way valve (65). Part of the refrigerant flowing through the first gas pipe (21) flows into the first header (51) of the main heat exchange part (50). The remaining part of the refrigerant passes through the gas connection pipe (24) and the liquid pipe (23) in this order, and then flows into the first header (56) of the auxiliary heat exchange part (55). In the main heat exchange part (50), the refrigerant flowing into the first header (51) flows so as to branch into the heat transfer pipes (53). In the auxiliary heat exchange part (55), the refrigerant flowing into the first header (56) flows so as to branch into the heat transfer pipes (58). While flowing through the refrigerant flow paths (49), the refrigerant flowing into each heat transfer pipe (53, 58) is condensed by dissipating heat. Frost formed on the outdoor heat exchanger (40) is heated and melted by the refrigerant flowing through each heat transfer pipe (53, 58).

Flows of the refrigerant having passed through the heat transfer pipes (53) of the main heat exchange part (50) are joined together at the second header (52) of the main heat exchange part (50), and then such refrigerant flows down to the second header (57) of the auxiliary heat exchange part (55). The refrigerant having passed through the heat transfer pipes (58) of the auxiliary heat exchange part (55) flows into the second header (57) of the auxiliary heat exchange part (55), and then joins the refrigerant having passed through the heat transfer pipes (53) of the main heat exchange part (50). The refrigerant flowing from the second header (57) of the auxiliary heat exchange part (55) to the liquid connection pipe (25) passes through the liquid pipe (23) and the indoor heat exchanger (32) in this order, and then flows into the second gas pipe (22). Subsequently, the refrigerant is sucked into the compressor (31) through the four-way valve (65). The compressor (31) compresses the sucked refrigerant and discharges the compressed refrigerant.

Advantages of the Embodiment

According to the present embodiment, the flow ratio controller (72) controls, in the air-heating operation (i.e., in the evaporation mode of the outdoor heat exchanger (40)), the flow ratio Vsub/Vmain of refrigerant of the heat exchange parts (50, 55) such that the temperature tmain of refrigerant having passed through the main heat exchange part (50) and the temperature tsub of refrigerant having passed through the auxiliary heat exchange part (55) are substantially equal to each other. Moreover, the superheat degree controller (71) controls the opening degree of the expansion valve (33) such that the superheat degree Tsh1 of refrigerant whose flows are joined together after passing through each heat exchange part (50, 55) reaches the predetermined superheat degree Tsh0. It is expected that these two types of control allow refrigerant flowing through each heat exchange part (50, 55) to be in the superheat state (i.e., the state in which the superheat degree is close to the predetermined superheat degree Tsh0). Thus, in each heat exchange part (50, 55), particularly in the auxiliary heat exchange part (55), surrounding air is not over-cooled by refrigerant, and therefore frost formation on the auxiliary heat exchange part (55) can be reduced. As a result, lowering of a heat change efficiency can be reduced. Meanwhile, in the main heat exchange part (50), the refrigerant flow volume Vmain is increased by the control using the flow ratio controller (72), and the amount of liquid refrigerant inflow increases accordingly. As a result, the evaporation amount of refrigerant can be increased. As just described, an evaporative capacity of the outdoor heat exchanger (40) can be improved by reduction in lowering of the heat exchange efficiency of the auxiliary heat exchange part (55) and a sufficient evaporation amount of refrigerant in the main heat exchange part (50).

According to the present embodiment, the flow volume adjustment valve (66) configured to adjust the flow ratio Vsub/Vmain is provided in the lower pipe (27). Thus, the refrigerant flow volume Vsub of the auxiliary heat exchange part (55) can be changed with high accuracy, and it can be ensured that frost formation on the auxiliary heat exchange part (55) is reduced.

According to the present embodiment, the number of heat transfer pipes (58) provided in the auxiliary heat exchange part (55) is less than the number of heat transfer pipes (53) provided in the main heat exchange part (50). If the heat transfer pipes (58) of the auxiliary heat exchange part (55) are fewer, the degree of unevenness of a refrigerant flow increases. Thus, in the auxiliary heat exchange part (55), the temperature of refrigerant further decreases, and therefore it is more likely that frost is formed on the auxiliary heat exchange part (55). However, even in this case, the control by the flow ratio controller (72) and the superheat degree controller (71) can reduce an excessive decrease in refrigerant temperature, and therefore it can be ensured that frost formation on the auxiliary heat exchange part (55) is reduced.

First Variation of the Embodiment

In the air conditioner (10) of the foregoing embodiment, the temperature t1 of refrigerant (i.e., refrigerant on the inlet side of the compressor (31)) whose flows are joined after passing through each heat exchange part (50, 55) is measured in order to obtain the superheat degree Tsh1 of refrigerant. However, the method for obtaining the superheat degree Tsh1 of refrigerant is not limited to such a method. Instead of measuring the temperature t1 of refrigerant on the inlet side of the compressor (31), the temperature tdis of refrigerant on an outlet side of the compressor (31) may be measured. Specifically, after the temperature tdis of refrigerant on the outlet side of the compressor (31) is measured, the temperature t1 of refrigerant on the inlet side of the compressor (31) is obtained with reference to a table showing a relationship between the temperature tdis of refrigerant on the outlet side and the temperature t1 of refrigerant on the inlet side. Then, the superheat degree Tsh1 of refrigerant is obtained by subtracting the equivalent saturation temperature ts1 of the pressure p1 (i.e., a measurement value) from the temperature t1 of refrigerant on the inlet side.

Second Variation of the Embodiment

Figure 9:
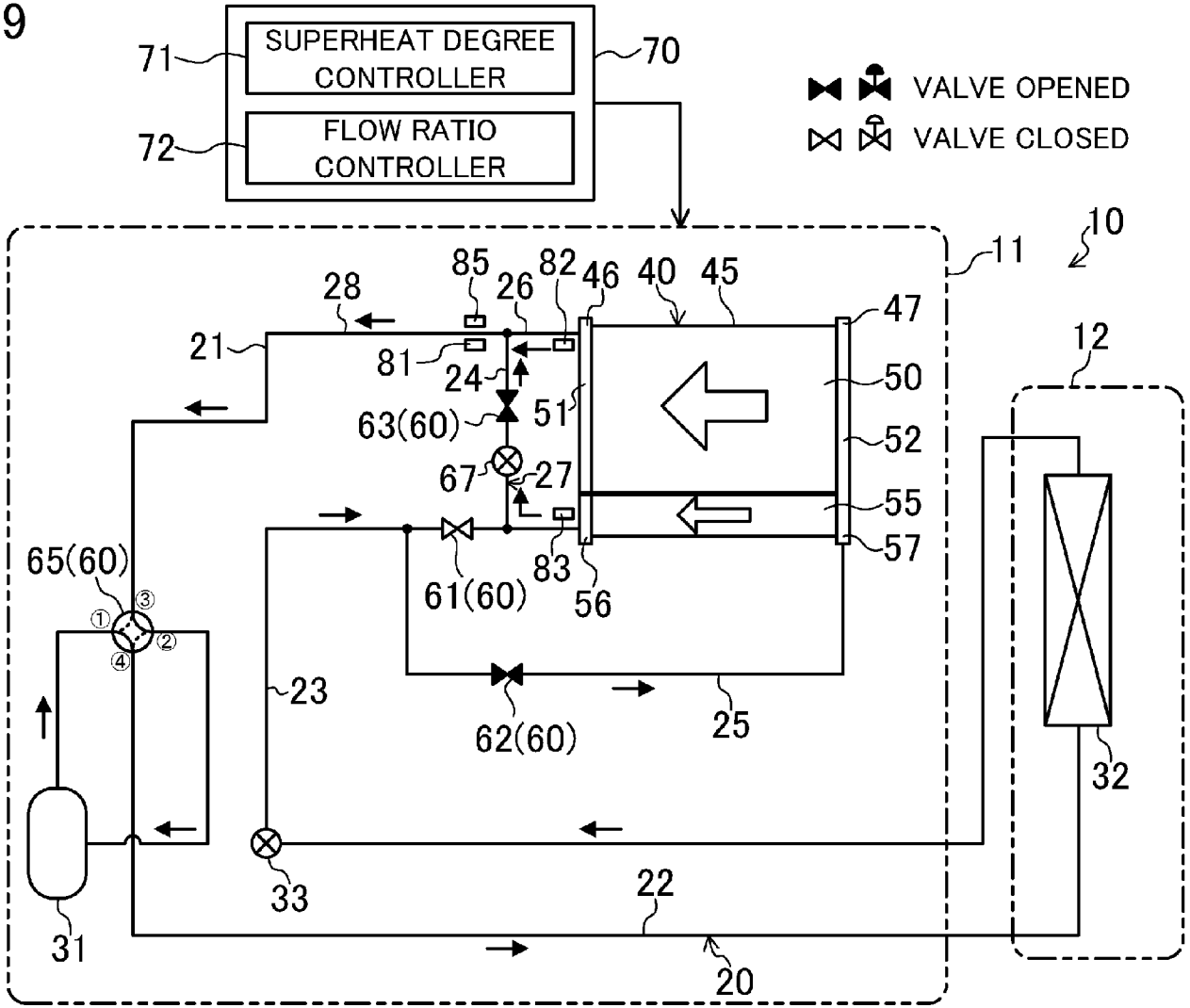
FIG. 9 is a refrigerant circuit diagram illustrating the state of an air conditioner of a second variation of the embodiment in an air-heating operation.

In the air conditioner (10) of the foregoing embodiment, the flow volume adjustment valve (66) is provided. However, a third solenoid valve (63) and an electronic expansion valve (67) may be provided as illustrated in FIG. 9, instead of providing the flow volume adjustment valve (66).

The third solenoid valve (63) is configured to switch opening/closing thereof to switch connection between the main heat exchange part (50) and the auxiliary heat exchange part (55). The third solenoid valve (63) forms part of the switching mechanism (60) of the present disclosure. The third solenoid valve (63) is closed in the condensation mode of the outdoor heat exchanger (40), and is opened in the evaporation mode of the outdoor heat exchanger (40). The electronic expansion valve (67) is configured to adjust an opening degree thereof in the evaporation mode of the outdoor heat exchanger (40) to adjust the flow ratio Vsub/Vmain of refrigerant. The electronic expansion valve (67) serves as the flow ratio adjustment mechanism of the present disclosure. The opening degree of the electronic expansion valve (67) is controlled by the flow ratio controller (72).

In the present variation, opening/closing of the third solenoid valve (63) is performed. Moreover, opening/closing of the electronic expansion valve (67) is not performed, but adjustment of the opening degree of the electronic expansion valve (67) is performed. Thus, as compared to the case where a single flow volume adjustment valve performs both of opening/closing thereof and adjustment of an opening degree thereof, it can be ensured that such processes are performed. As a result, false operation can be avoided.

Third Variation of the Embodiment

Figure 10:
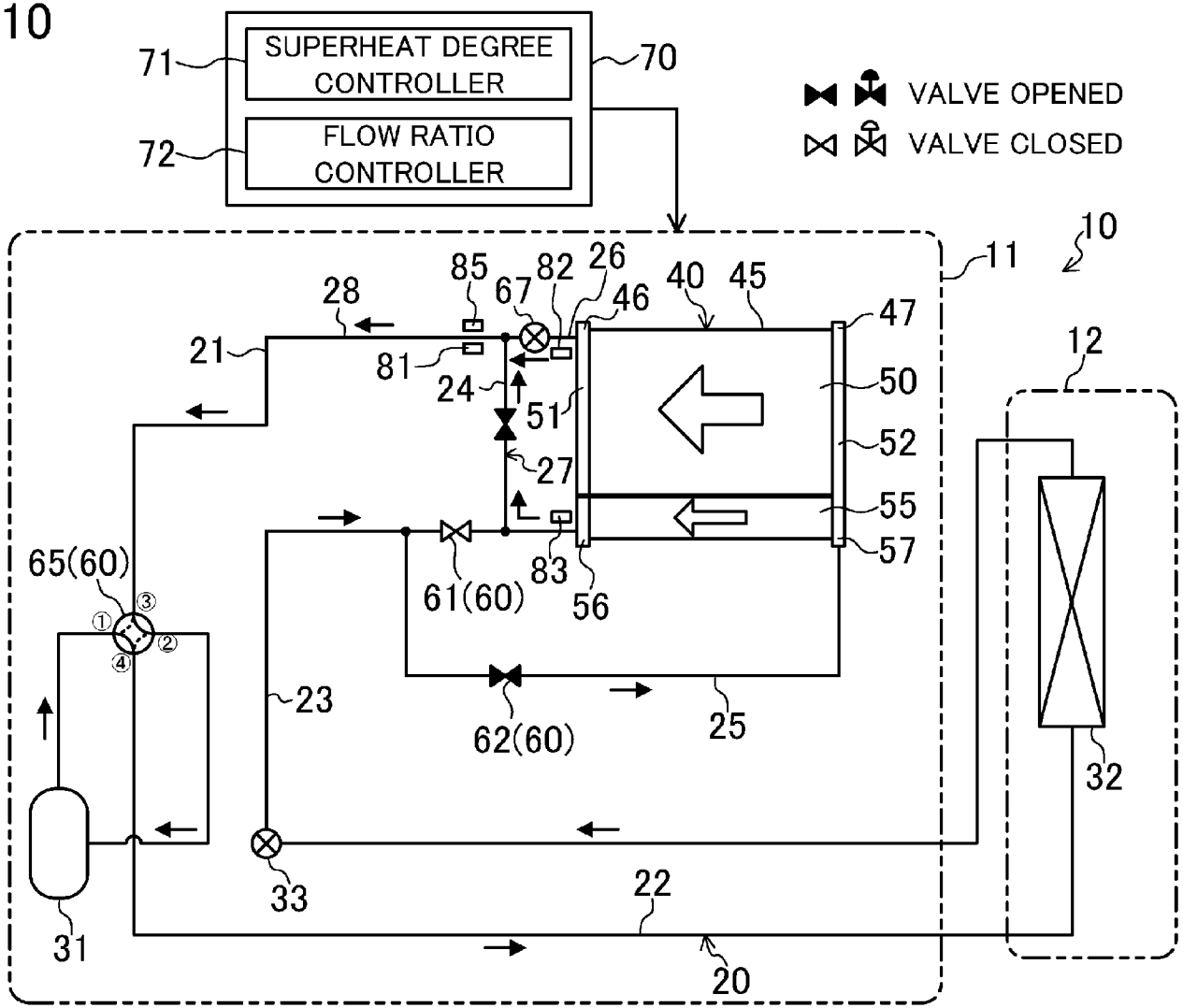
FIG. 10 is a refrigerant circuit diagram illustrating the state of an air conditioner of a third variation of the embodiment in an air-heating operation.

In the air conditioner (10) of the second variation of the embodiment, the electronic expansion valve (67) is provided in the lower pipe (27). However, the electronic expansion valve (67) may be provided in the upper pipe (26) as illustrated in FIG. 10.

In such a case, when the opening degree of the electronic expansion valve (67) increases, the refrigerant flow volume Vmain of the main heat exchange part (50) increases. The refrigerant flow volume Vsub of the auxiliary heat exchange part (55) is decreased by the increase in refrigerant flow volume Vmain. On the other hand, when the opening degree of the electronic expansion valve (67) decreases, the refrigerant flow volume Vmain of the main heat exchange part (50) decreases. The refrigerant flow volume Vsub of the auxiliary heat exchange part (55) is increased by the decrease in refrigerant flow volume Vmain. As just described, even in the case where the electronic expansion valve (67) is provided in the upper pipe (26), the flow ratio Vsub/Vmain of refrigerant can be adjusted.

Other Embodiment

Each of the foregoing embodiments may have the following configurations.

First Variation

Figure 11:
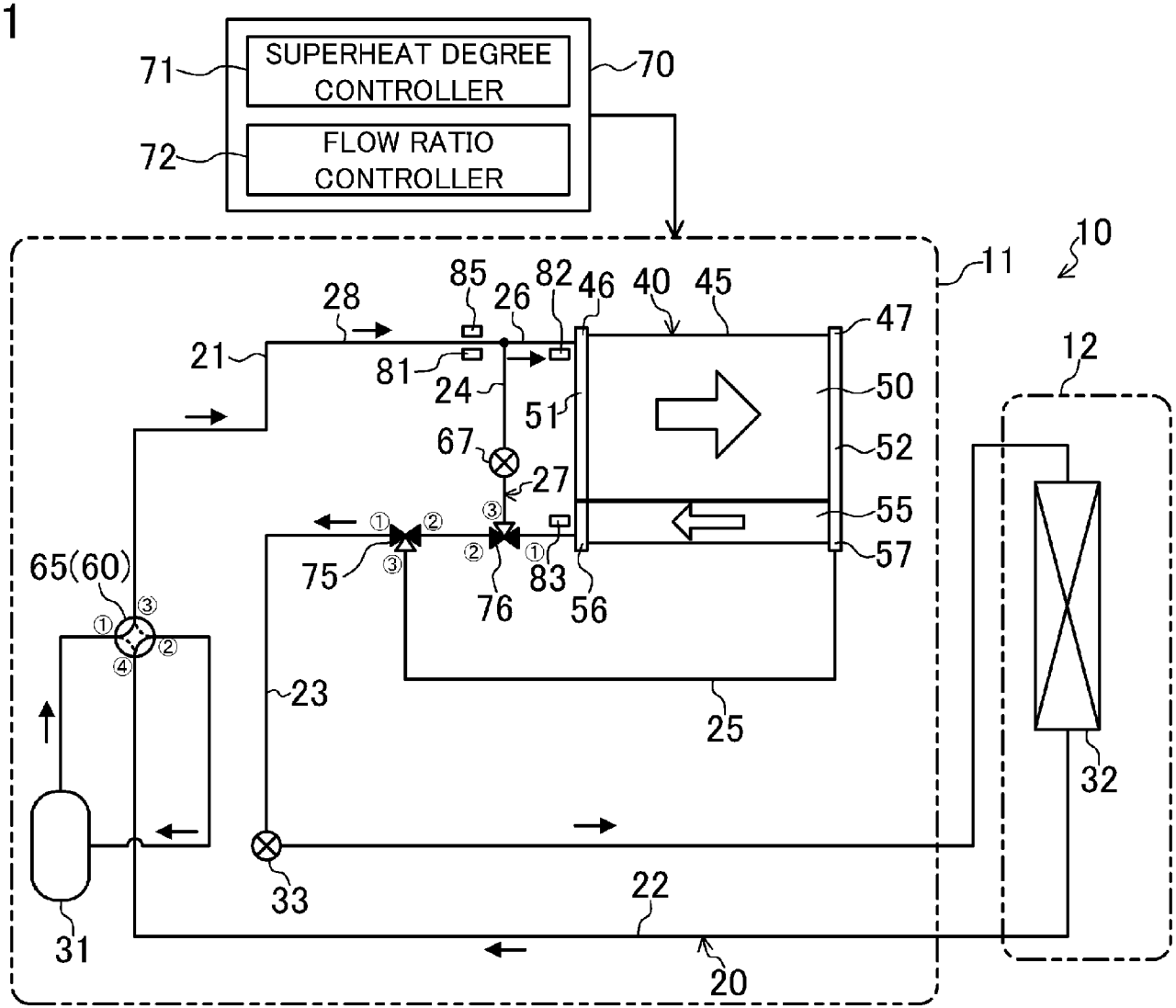
FIG. 11 is a refrigerant circuit diagram illustrating the state of an air conditioner of a first variation of other embodiment in an air-cooling operation.
Figure 12:
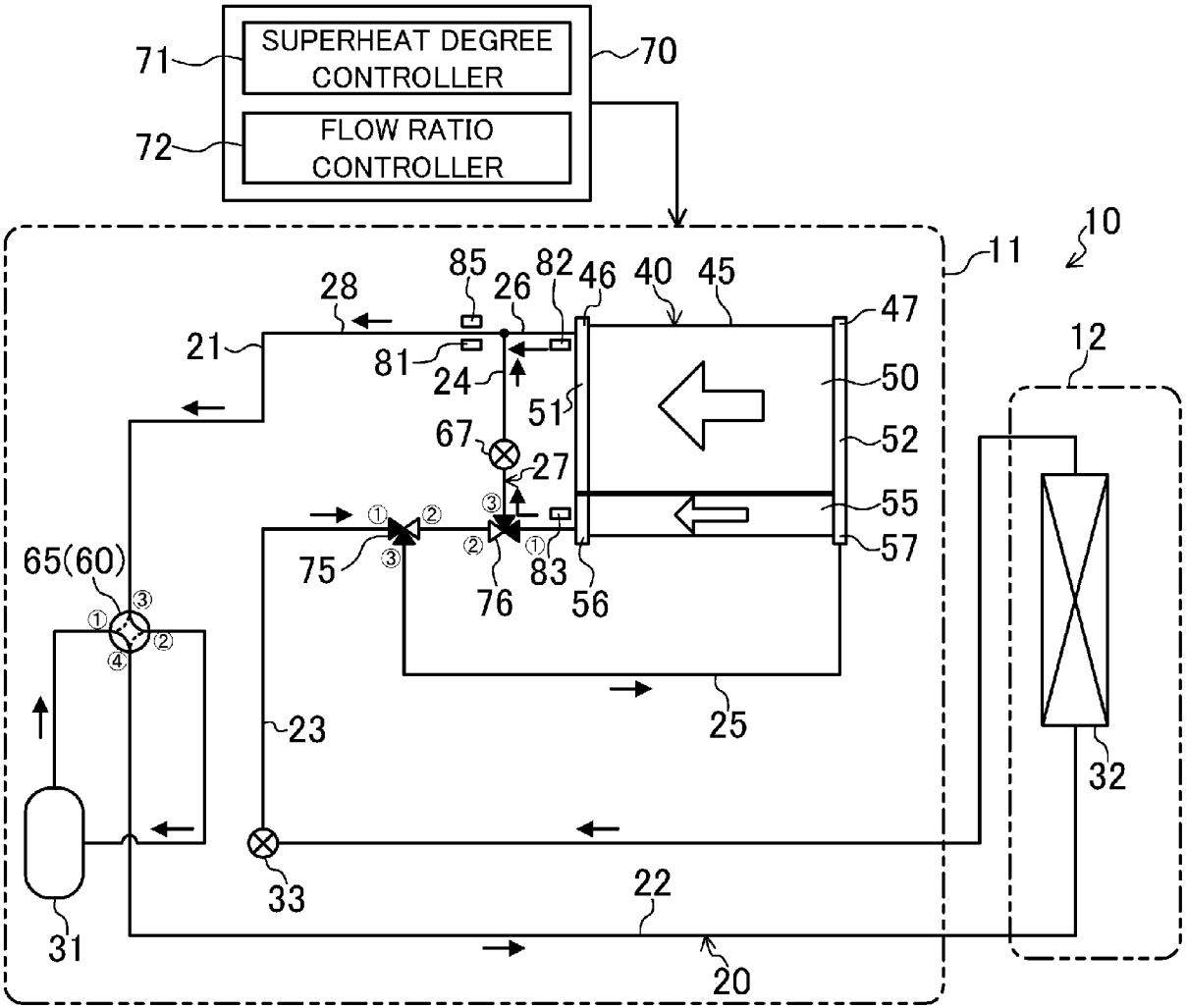
FIG. 12 is a refrigerant circuit diagram illustrating the state of the air conditioner of the first variation of the other embodiment in an air-heating operation.

In the air conditioner (10) of the second variation of the embodiment, the three solenoid valves (61, 62, 63) switch opening/closing thereof to switch the connection between the main heat exchange part (50) and the auxiliary heat exchange part (55). However, switching of the connection between the main heat exchange part (50) and the auxiliary heat exchange part (55) is not limited to the foregoing. For example, two three-way valves (75, 76) may be used as illustrated in FIGS. 11 and 12.

The first three-way valve (75) is provided at a connection part between the liquid pipe (23) and the liquid connection pipe (25). A first port of the first three-way valve (75) is connected to part of the liquid pipe (23) close to the expansion valve (33), a second port of the first three-way valve (75) is connected to part of the liquid pipe (23) close to the outdoor heat exchanger (40), and a third port of the first three-way valve (75) is connected to one end of the liquid connection pipe (25). The second three-way valve (76) is provided at a connection part between the liquid pipe (23) and the gas connection pipe (24). A first port of the second three-way valve (76) is connected to part of the liquid pipe (23) close to the outdoor heat exchanger (40), a second port of the second three-way valve (76) is connected to part of the liquid pipe (23) close to the expansion valve (33), and a third port of the second three-way valve (76) is connected to one end of the gas connection pipe (24). The three-way valves (75, 76) form part of the switching mechanism (60) of the present disclosure.

In the condensation mode of the outdoor heat exchanger (40), each three-way valve (75, 76) is set to the state (i.e., the state illustrated in FIG. 11) in which the first and second ports communicate with each other and the third port is closed, and the main heat exchange part (50) and the auxiliary heat exchange part (55) are connected together in series. On the other hand, in the evaporation mode of the outdoor heat exchanger (40), each three-way valve (75, 76) is set to the state (i.e., the state illustrated in FIG. 12) in which the first and third ports communicate with each other and the second port is closed, and the main heat exchange part (50) and the auxiliary heat exchange part (55) are connected together in parallel.

Second Variation

Figure 13:
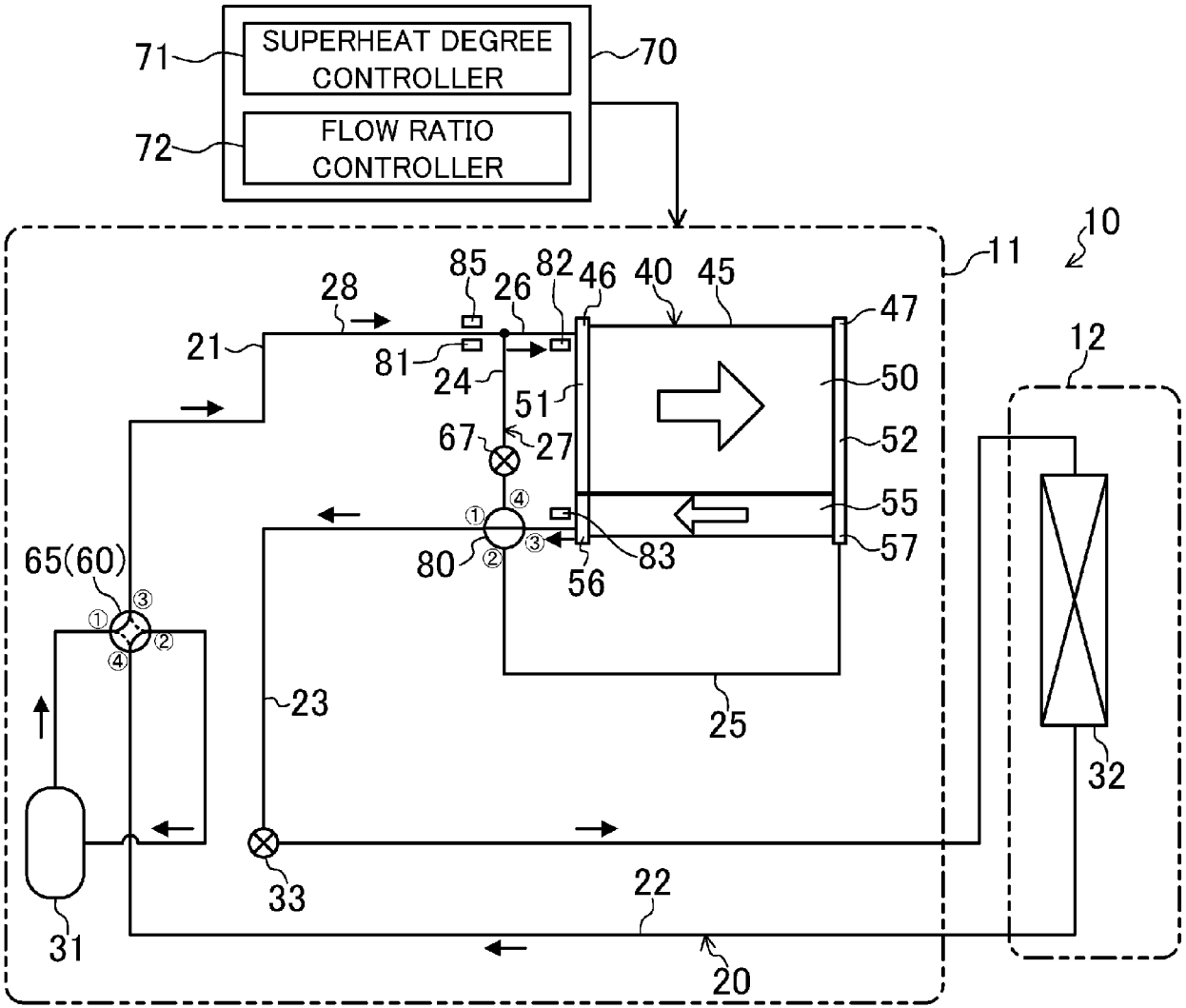
FIG. 13 is a refrigerant circuit diagram illustrating the state of an air conditioner of a second variation of the other embodiment in an air-cooling operation.
Figure 14:
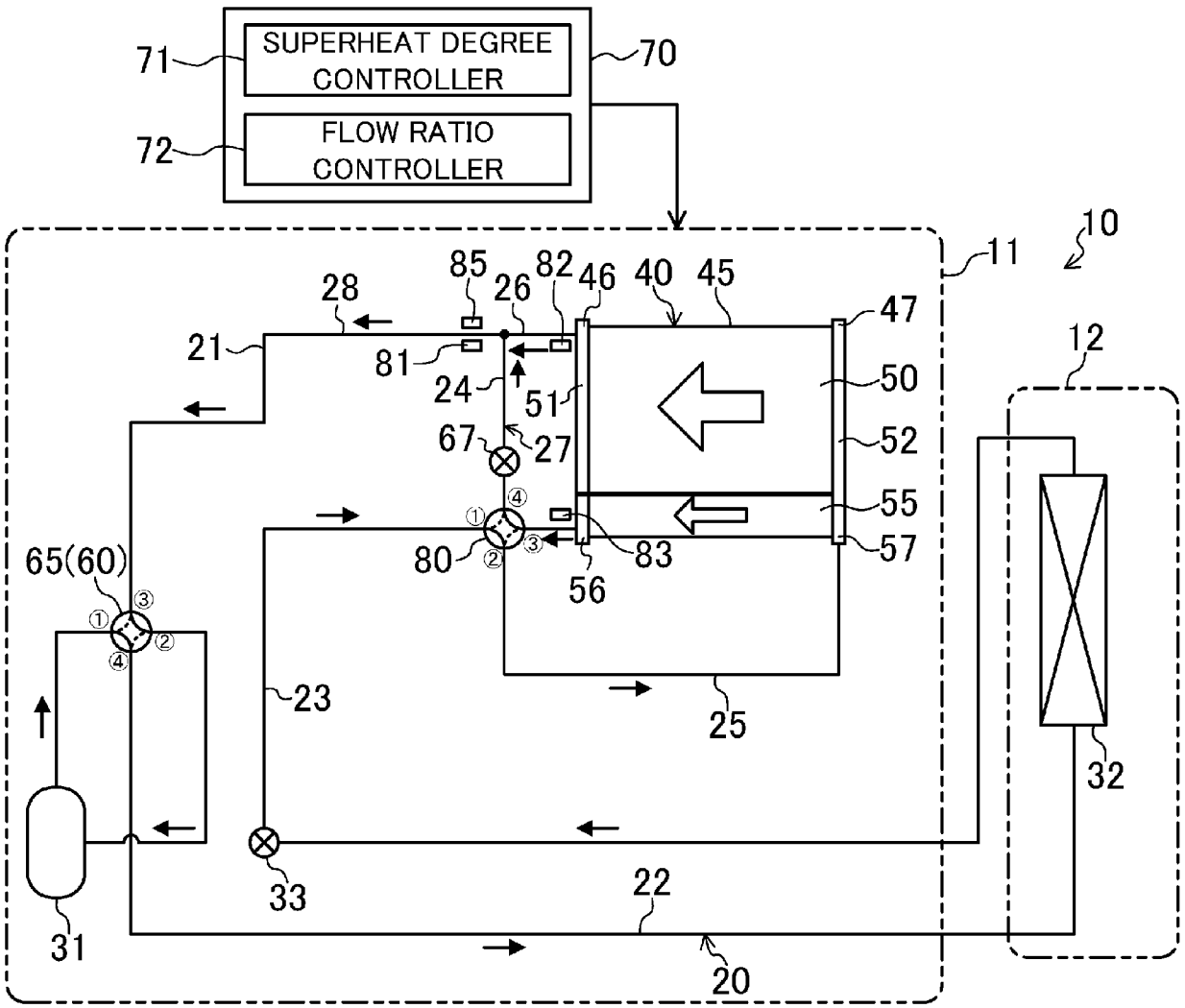
FIG. 14 is a refrigerant circuit diagram illustrating the state of the air conditioner of the second variation of the other embodiment in an air-heating operation.

In the air conditioner (10) of the second variation of the embodiment, the three solenoid valves (61, 62, 63) switch opening/closing thereof to switch the connection between the main heat exchange part (50) and the auxiliary heat exchange part (55). However, switching of the connection between the main heat exchange part (50) and the auxiliary heat exchange part (55) is not limited to the foregoing. For example, a four-way valve (80) may be used as illustrated in FIGS. 13 and 14.

The four-way valve (80) is provided at part of the liquid pipe (23) where the liquid connection pipe (25) and the gas connection pipe (24) are connected together. A first port of the four-way valve (80) is connected to part of the liquid pipe (23) close to the expansion valve (33), a second port of the four-way valve (80) is connected to one end of the liquid connection pipe (25), a third port of the four-way valve (80) is connected to part of the liquid pipe (23) close to the outdoor heat exchanger (40), and a fourth port of the four-way valve (80) is connected to one end of the gas connection pipe (24). The four-way valve (80) forms part of the switching mechanism (60) of the present disclosure.

In the condensation mode of the outdoor heat exchanger (40), the four-way valve (80) is set to the state (i.e., the state illustrated in FIG. 13) in which the first and third ports communicate with each other and the second and fourth ports communicate with each other, and the main heat exchange part (50) and the auxiliary heat exchange part (55) are connected together in series. On the other hand, in the evaporation mode of the outdoor heat exchanger (40), the four-way valve (80) is set to the state (i.e., the state illustrated in FIG. 14) in which the first and second ports communicate with each other and the third and fourth ports communicate with each other, and the main heat exchange part (50) and the auxiliary heat exchange part (55) are connected together in parallel.

Third Variation

In the air conditioner (10) of the foregoing embodiment, the outdoor heat exchanger (40) includes the single heat exchanger unit (45). However, the present disclosure is not limited to such a configuration, and the outdoor heat exchanger (40) may include a plurality of heat exchanger units (45*a*, 45*b*).

Figure 15:
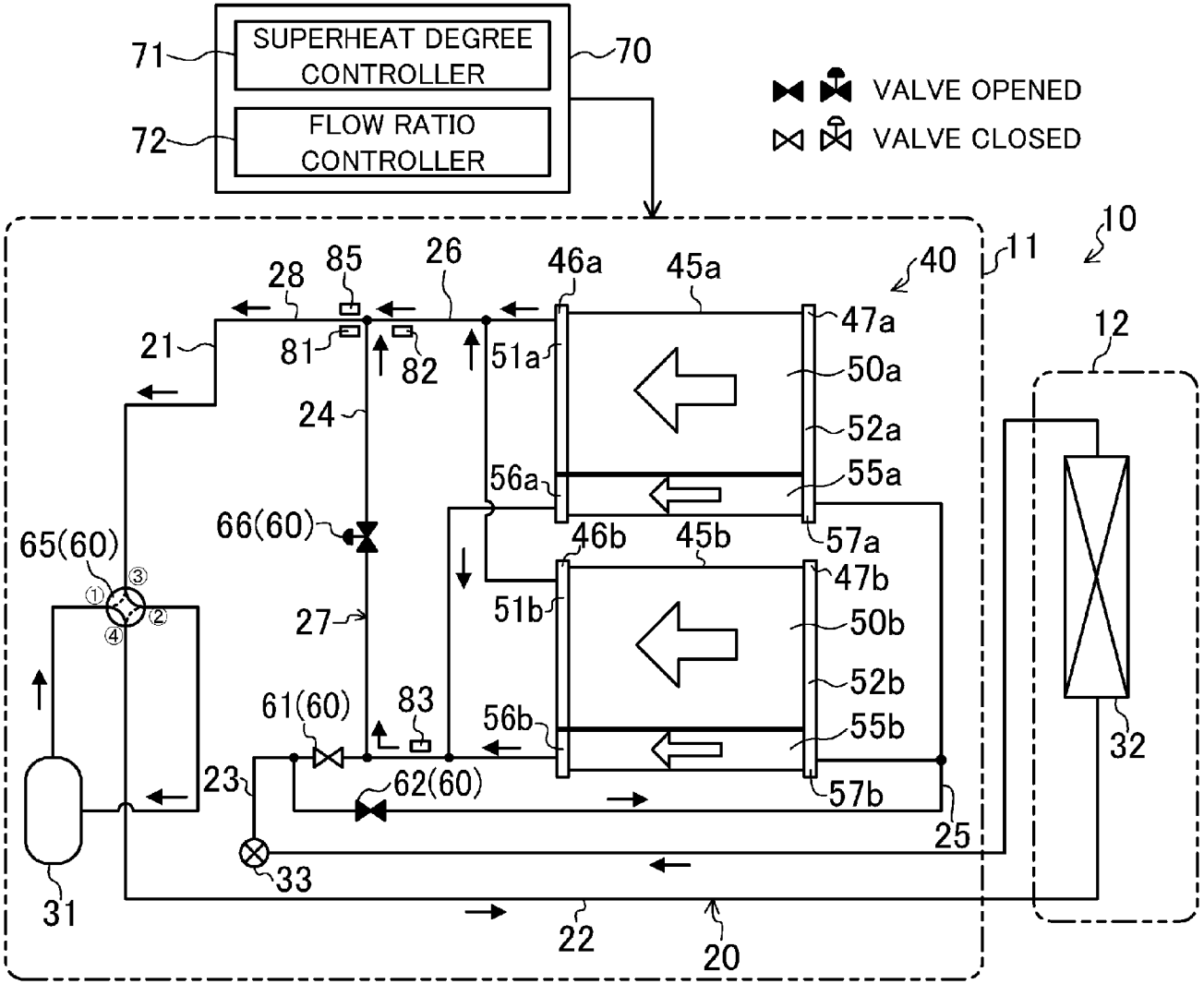
FIG. 15 is a refrigerant circuit diagram illustrating the state of an air conditioner of a third variation of the other embodiment in an air-heating operation.
Figure 16:
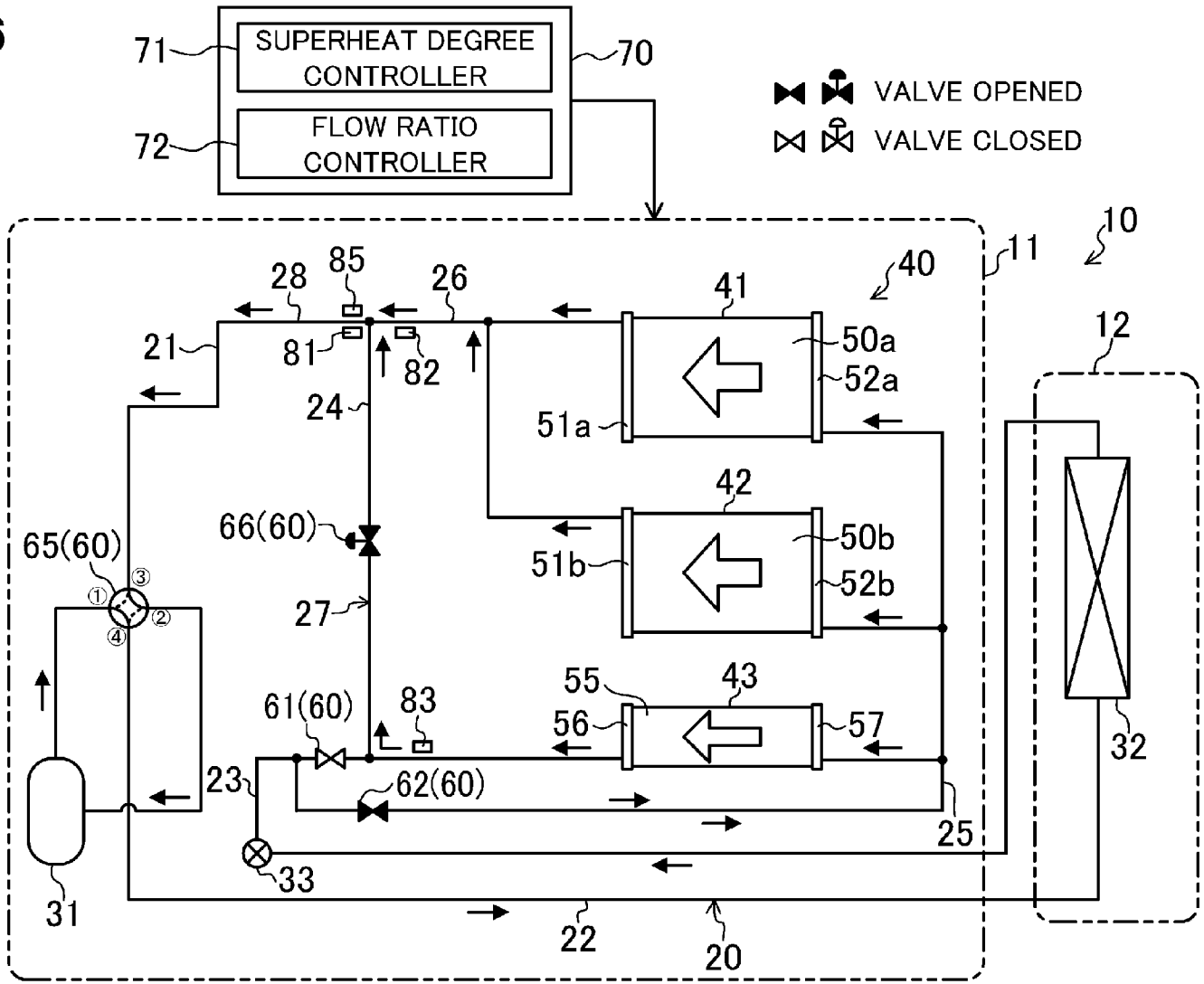
FIG. 16 is a refrigerant circuit diagram illustrating the state of an air conditioner of a fourth variation of the other embodiment in an air-heating operation.

In the present variation, the outdoor heat exchanger (40) includes two heat exchanger units (45*a*, 45*b*) as illustrated in FIG. 15. The liquid connection pipe (25) branches on a side close to the outdoor heat exchanger (40), and each branch part of the liquid connection pipe (25) is connected to a corresponding one of second headers (57*a*, 57*b*) of auxiliary heat exchange parts (55*a*, 55*b*) of the heat exchanger units (45*a*, 45*b*). Moreover, the first gas pipe (21) branches on a side close to the outdoor heat exchanger (40), and each branch part of the first gas pipe (21) is connected to a corresponding one of first headers (51*a*, 51*b*) of main heat exchange parts (50*a*, 50*b*) of the heat exchanger units (45*a*, 45*b*). Further, the liquid pipe (23) branches on a side close to the outdoor heat exchanger (40), and each branch part of the liquid pipe (23) is connected to a corresponding one of first headers (56*a*, 56*b*) of the auxiliary heat exchange parts (55*a*, 55*b*) of the heat exchanger units (45*a*, 45*b*).

According to the present variation, in the air-heating operation (i.e., the evaporation mode of the outdoor heat exchanger (40)), refrigerant branches in the liquid connection pipe (25), and then flows into each second header (57*a*, 57*b*) of the auxiliary heat exchange parts (55*a*, 55*b*) of the heat exchanger units (45*a*, 45*b*). In each heat exchanger unit (45*a*, 45*b*), the refrigerant flows so as to branch into the main heat exchange part (50*a*, 50*b*) and the auxiliary heat exchange part (55*a*, 55*b*), and passes through each heat exchange part (50*a*, 50*b*, 55*a*, 55*b*). The refrigerant having passed through each main heat exchange part (50*a*, 50*b*) of the heat exchanger units (45*a*, 45*b*) flows out to the first gas pipe (21) through a corresponding one of the first headers (51*a*, 51*b*). Subsequently, after flows of such refrigerant are joined together, the refrigerant flows to the junction (i.e., the connection part between the first gas pipe (21) and the gas connection pipe (24)). Meanwhile, the refrigerant having passed through each auxiliary heat exchange part (55*a*, 55*b*) of the heat exchanger units (45*a*, 45*b*) flows out to the liquid pipe (23) through a corresponding one of the first headers (56*a*, 56*b*). Subsequently, after flows of such refrigerant are joined together, the refrigerant flows into the gas connection pipe (24), and joins the refrigerant having passed through the main heat exchange parts (50*a*, 50*b*) at the junction.

According to the present variation, in the flow ratio controller (72), the flow ratio Vsub/Vmain is controlled such that the temperature tmain (measured by the second temperature sensor (82)) of refrigerant whose flows are joined together after passing through the main heat exchange parts (50*a*, 50*b*) and the temperature tsub (measured by the third temperature sensor (83)) of refrigerant whose flows are joined together after passing through the auxiliary heat exchange parts (55*a*, 55*b*) are substantially equal to each other. In this case, the refrigerant flow volume Vmain is the sum of the flow volumes of refrigerant of the main heat exchange parts (50*a*, 50*b*), and the refrigerant flow volume Vsub is the sum of the flow volumes of refrigerant of the auxiliary heat exchange parts (55*a*, 55*b*).

In the present variation, the outdoor heat exchanger (40) includes the two heat exchanger units (45*a*, 45*b*). However, the number of heat exchanger units is not limited to two.

Fourth Variation

In the air conditioner (10) of the foregoing embodiment, the main heat exchange part (50) and the auxiliary heat exchange part (55) are provided inside the heat exchanger unit (45). However, as long as the main heat exchange part (50) and the auxiliary heat exchange part (55) are arranged in the vertical direction, the main heat exchange parts (50*a*, 50*b*) and the auxiliary heat exchange part (55) may be provided respectively in different heat exchanger units (41, 42, 43), and such heat exchanger units (41, 42, 43) may be arranged in the vertical direction.

In the present variation, the main heat exchange part (50*a*) is provided in the main heat exchanger unit (41), and the main heat exchange part (50*b*) is provided in the main heat exchanger unit (42). The auxiliary heat exchange part (55) is provided in the auxiliary heat exchanger unit (43). The liquid connection pipe (25) branches, and each branch part of the liquid connection pipe (25) is connected to a corresponding one of second headers (52*a*, 52*b*, 57) of the heat exchanger units (41, 42, 43). Moreover, the first gas pipe (21) branches, and each branch part of the first gas pipe (21) is connected to a corresponding one of the first headers (51*a*, 51*b*) of the heat exchanger units (41, 42). The liquid pipe (23) is connected to the first header (56) of the auxiliary heat exchange unit (43).

According to the present variation, in the air-heating operation (i.e., the evaporation mode of the outdoor heat exchanger (40)), refrigerant flows so as to branch in the liquid connection pipe (25), and then flows into each second header (52*a*, 52*b*, 57) of the main heat exchanger units (41, 42) and the auxiliary heat exchanger unit (43). The refrigerant flowing into each main heat exchanger unit (41, 42) flows out to the first gas pipe (21) through a corresponding one of the main heat exchange parts (50*a*, 50*b*) and a corresponding one of the first headers (51*a*, 51*b*). Subsequently, after flows of such refrigerant are joined together, the refrigerant flows into the junction (i.e., the connection part between the first gas pipe (21) and the gas connection pipe (24)). Meanwhile, the refrigerant flowing into the auxiliary heat exchange unit (43) flows out to the liquid pipe (23) through the auxiliary heat exchange part (55) and the first header (56). The refrigerant having passed through the auxiliary heat exchange part (55) flows into the gas connection pipe (24) through the liquid pipe (23), and then joins the refrigerant having passed through the main heat exchange parts (50*a*, 50*b*) at the junction.

According to the present variation, in the flow ratio controller (72), the flow ratio Vsub/Vmain is controlled such that the temperature tmain (measured by the second temperature sensor (82)) of refrigerant whose flows are joined together after passing through the main heat exchange parts (50*a*, 50*b*) and the temperature tsub (measured by the third temperature sensor (83)) of refrigerant having passed through the auxiliary heat exchange part (55) are substantially equal to each other. In this case, the refrigerant flow volume Vmain is the sum of the flow volumes of refrigerant of the main heat exchange parts (50*a*, 50*b*).

In the present variation, the outdoor heat exchanger (40) includes the two main heat exchanger units (41, 42) and the single auxiliary heat exchanger unit (43). However, a single main heat exchanger unit or a plurality of main heat exchanger units may be provided, and a single auxiliary heat exchanger unit or a plurality of auxiliary heat exchanger units may be provided.

INDUSTRIAL APPLICABILITY

As described above, the present disclosure is useful for a refrigerating apparatus configured such that an air-cooling/air-heating operation is performed using refrigerant circulating in a refrigerant circuit in which an outdoor heat exchanger and an indoor heat exchanger are connected together.

DESCRIPTION OF REFERENCE CHARACTERS

10 Air Conditioner (Refrigerating Apparatus)
20 Refrigerant Circuit

26 Upper Pipe
27 Lower Pipe
28 Junction Pipe
31 Compressor
32 Indoor Heat Exchanger (Utilization-Side Heat Exchanger)
33 Expansion Valve
40 Outdoor Heat Exchanger (Heat-Source-Side Heat Exchanger)
50 Main Heat Exchange Part
51 First Header
52 Second Header
53 Heat Transfer Pipe
54 Fin
55 Auxiliary Heat Exchange Part
56 First Header
57 Second Header
58 Heat Transfer Pipe
59 Fin
60 Switching Mechanism
66 Flow Volume Adjustment Valve (Flow Ratio Adjustment Mechanism)
67 Electronic Expansion Valve (Flow Ratio Adjustment Mechanism)
71 Superheat Degree Controller
72 Flow Ratio Controller

The invention claimed is:

1. A refrigerating apparatus including a refrigerant circuit in which a compressor, a heat-source-side heat exchanger, an expansion valve, and a utilization-side heat exchanger are connected together and which is configured to perform a refrigeration cycle, in which the heat-source-side heat exchanger includes an upper main heat exchange part and a lower auxiliary heat exchange part arranged in a vertical direction, the main heat exchange part and the auxiliary heat exchange part each include a standing first header and a standing second header, a plurality of flat heat transfer pipes which are arranged in the vertical direction and which are connected, at one end thereof, to the first header and connected, at the other end thereof, to the second header, and a fin joined between adjacent ones of the heat transfer pipes, and a switching mechanism configured to switch the heat-source-side heat exchanger between an evaporation mode in which refrigerant is evaporated in the heat-source-side heat exchanger while flowing so as to branch into the main heat exchange part and the auxiliary heat exchange part and a condensation mode in which the refrigerant is condensed while passing through the main heat exchange part and the auxiliary heat exchange part in this order is provided, the refrigerating apparatus comprising:

a superheat degree controller configured to control, in the evaporation mode of the heat-source-side heat exchanger, an opening degree of the expansion valve such that a superheat degree of the refrigerant whose flows are joined together after passing through the main heat exchange part and the auxiliary heat exchange part reaches a predetermined superheat degree;

a flow ratio adjustment mechanism configured to adjust, in the evaporation mode of the heat-source-side heat exchanger, a flow ratio between the refrigerant flowing through the main heat exchange part and the refrigerant flowing through the auxiliary heat exchange part; and a flow ratio controller configured to control the flow ratio adjustment mechanism such that a temperature of the refrigerant having passed through the main heat exchange part and a temperature of the refrigerant having passed through the auxiliary heat exchange part are substantially equal to each other.

2. The refrigerating apparatus of claim 1, wherein the refrigerant circuit further includes an upper pipe into which the refrigerant flows from the main heat exchange part in the evaporation mode of the heat-source-side heat exchanger, a lower pipe into which the refrigerant flows from the auxiliary heat exchange part in the evaporation mode of the heat-source-side heat exchanger, and a junction pipe at which the refrigerant flowing through the upper pipe and the refrigerant flowing through the lower pipe are joined together in the evaporation mode of the heat-source-side heat exchanger, and the flow ratio adjustment mechanism is provided in the lower pipe, and includes a flow volume adjustment valve configured to adjust a flow volume of the refrigerant flowing through the lower pipe.

3. The refrigerating apparatus of claim 2, wherein of the heat transfer pipes, heat transfer pipes provided in the auxiliary heat exchange part is fewer than heat transfer pipes provided in the main heat exchange part.

4. The refrigerating apparatus of claim 1, wherein of the heat transfer pipes, heat transfer pipes provided in the auxiliary heat exchange part is fewer than heat transfer pipes provided in the main heat exchange part.

* * * * *